US011788326B1

(12) United States Patent
Taylor

(10) Patent No.: US 11,788,326 B1
(45) Date of Patent: Oct. 17, 2023

(54) SPRING-OPERATED CATCH MECHANISM

(71) Applicant: Alan Taylor, Myakka City, FL (US)

(72) Inventor: Alan Taylor, Myakka City, FL (US)

( * ) Notice: Subject to any disclaimer, the term of this patent is extended or adjusted under 35 U.S.C. 154(b) by 0 days.

(21) Appl. No.: 17/488,676

(22) Filed: Sep. 29, 2021

Related U.S. Application Data

(63) Continuation-in-part of application No. 16/877,199, filed on May 18, 2020.

(60) Provisional application No. 62/849,572, filed on May 17, 2019.

(51) Int. Cl.
*E05C 1/08* (2006.01)

(52) U.S. Cl.
CPC ..... *E05C 1/08* (2013.01)

(58) Field of Classification Search
None
See application file for complete search history.

(56) References Cited

U.S. PATENT DOCUMENTS

2004/0257805 A1* 12/2004 Lee ..... F16M 11/041 362/655
2008/0191497 A1* 8/2008 Mayo ..... E06B 9/04 292/169

* cited by examiner

*Primary Examiner* — Heather R Jones

(57) ABSTRACT

Spring operated catch mechanisms to secure components together.

3 Claims, 21 Drawing Sheets

SPRING-OPERATED CATCH MECHANISM

CROSS-REFERENCE TO RELATED APPLICATIONS

This application is a continuation-in-part of U.S. patent application Ser. No. 16/877,199, filed May 18, 2020 which claims the benefit of U.S. Provisional Patent Application 62/849,572, filed May 17, 2019. All subject matter set forth in U.S. patent application Ser. No. 16/877,199 and U.S. Provisional Patent Application 62/849,572 are hereby incorporated by reference into the present patent application as if fully set forth herein.

FIELD OF THE APPARATUS

The present apparatus relates to spring-operated catch mechanisms to secure components together.

BACKGROUND OF THE INVENTION

Conventional locking mechanisms require some form of activation for components to be securely locked or fastened. This requires users to align the components and then activate the locking mechanism. There is a need for a locking mechanism which automatically locks together components when properly aligned and is activated to release the locking mechanism.

SUMMARY OF THE APPARATUS

It is therefore an object of the present apparatus to provide a locking mechanism which automatically locks together components when properly aligned and is activated to release the locking mechanism.

Certain terminology and derivations thereof maybe used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The apparatus will be better understood and objects other than those set forth above will become apparent when consideration is given to the following detailed description thereof. Such description makes reference to the annexed drawings, wherein:

FIG. 1I is an enlarged portion of FIG. 10;

Similar reference characters refer to similar parts throughout the several Figures of the drawings.

DETAILED DESCRIPTION OF THE EMBODIMENTS

The present invention is a spring-operated catch mechanism which automatically locks together components when properly aligned and only activated to release the locking mechanism.

Figure 1:
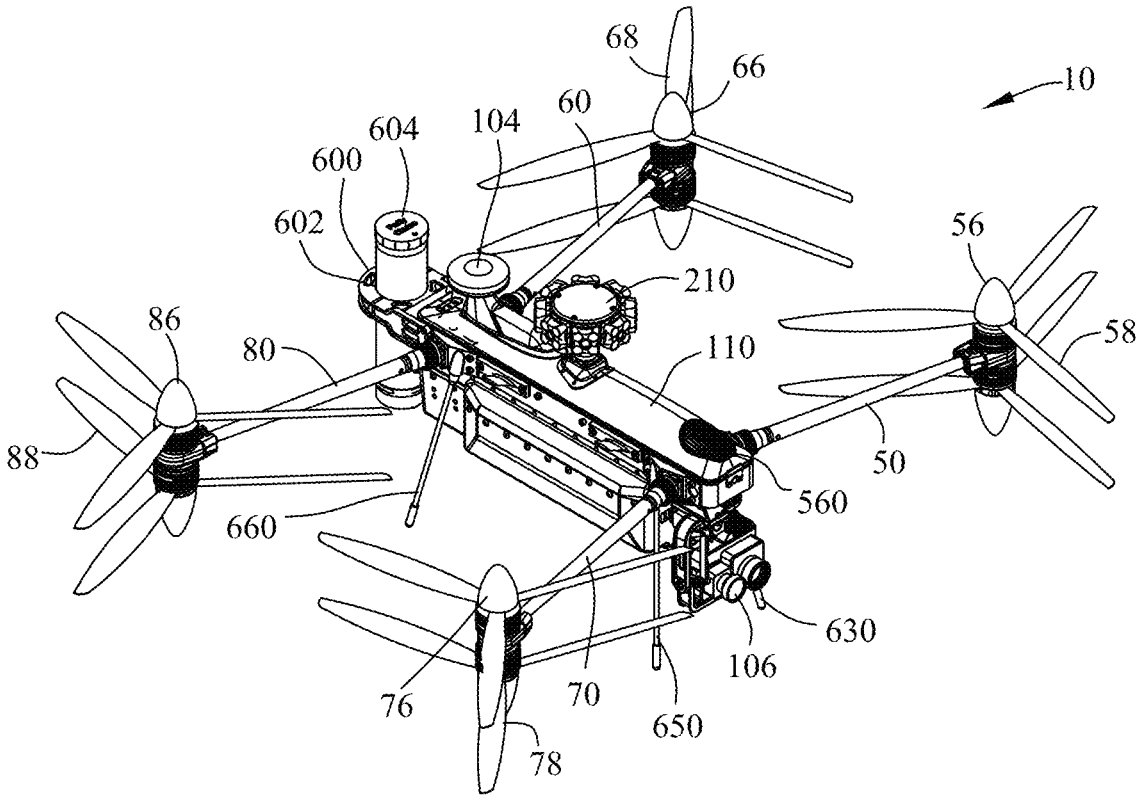
FIG. 1 is a front isometric view of an unmanned aerial vehicle incorporating the present invention.
Figure 2:
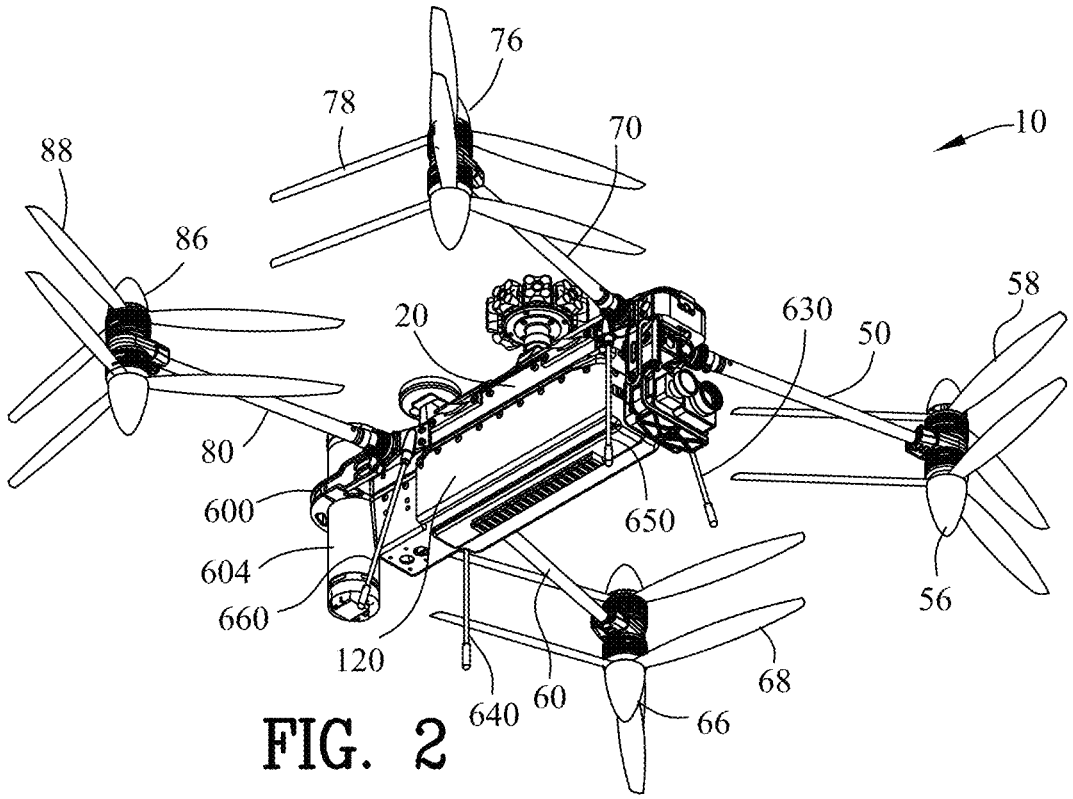
FIG. 2 is a rear isometric view of FIG. 1.
Figure 3:
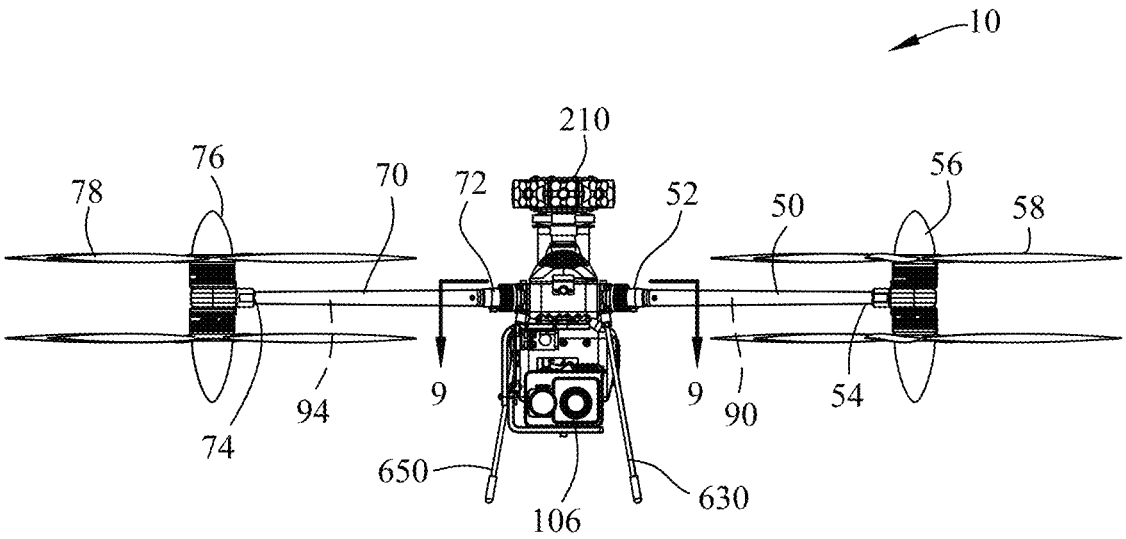
FIG. 3 is a front view of FIG. 1.
Figure 4:
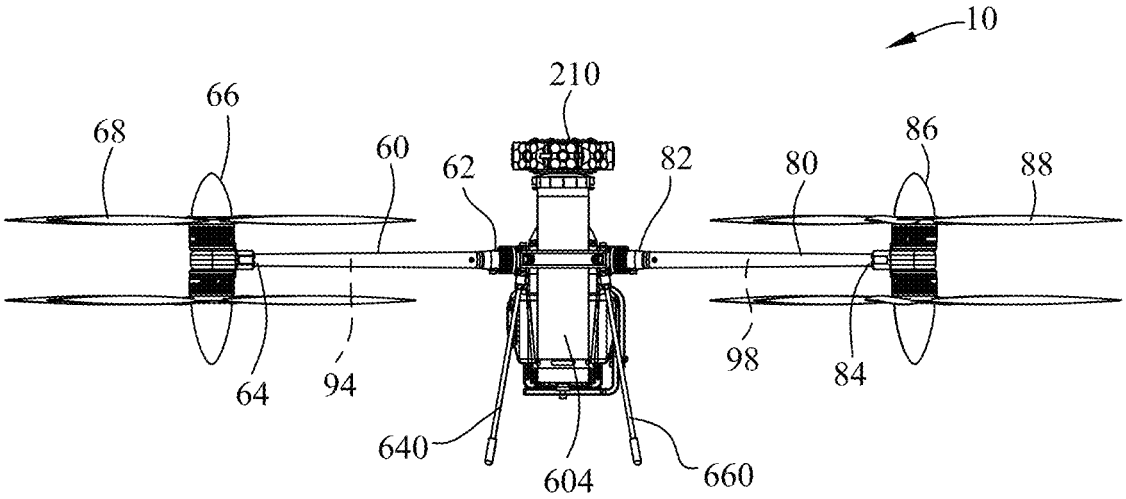
FIG. 4 is a right side view of FIG. 1.
Figure 5:
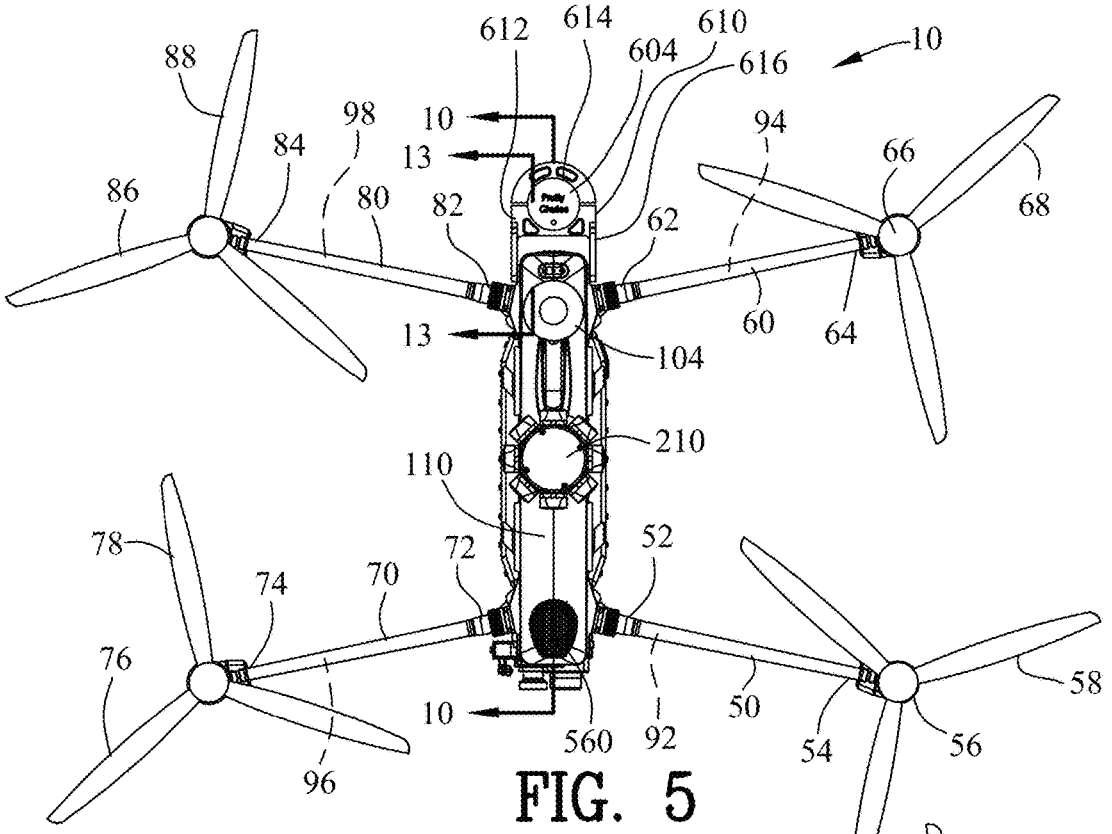
FIG. 5 is a top view of FIG. 1.
Figure 6:
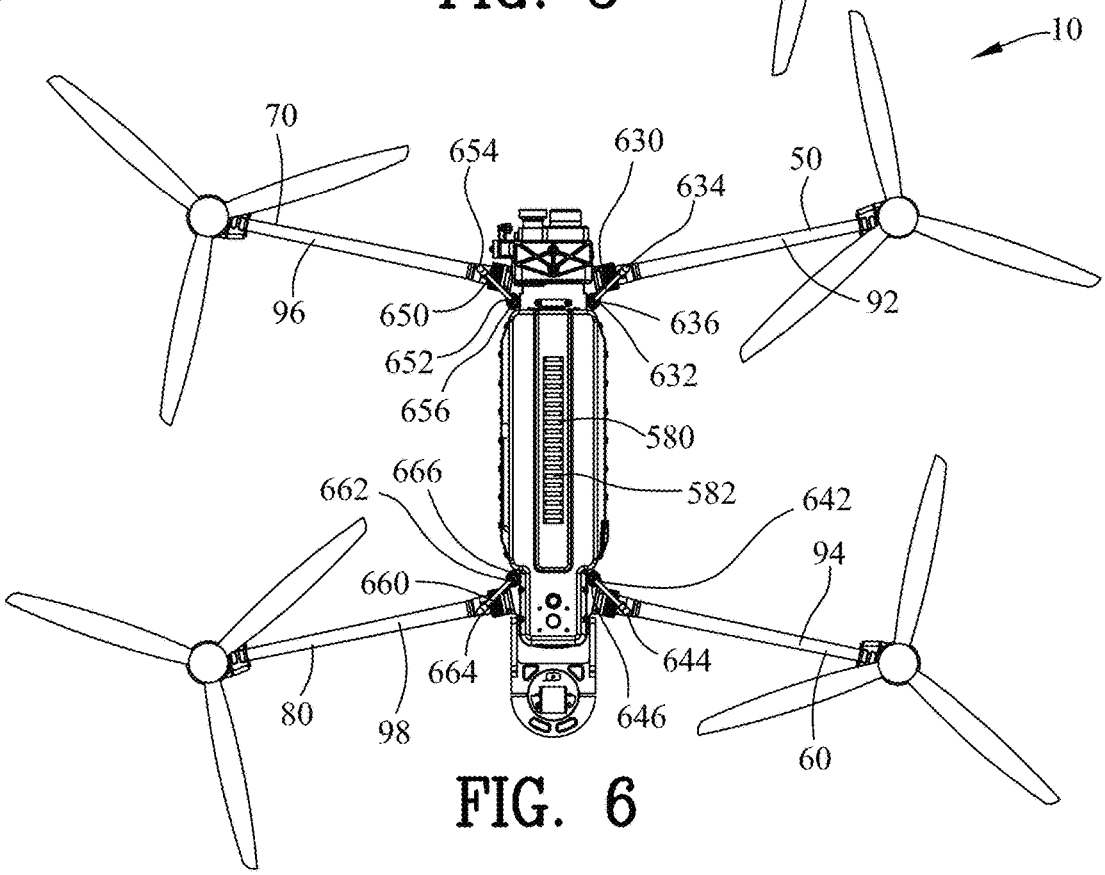
FIG. 6 is a bottom view of FIG. 1.
Figure 7:
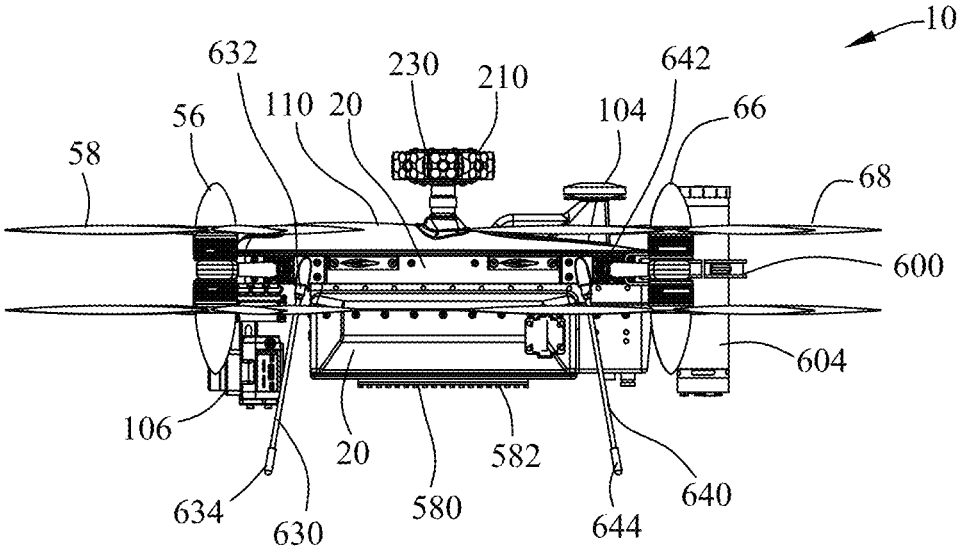
FIG. 7 is a right side view of FIG. 1.
Figure 8:
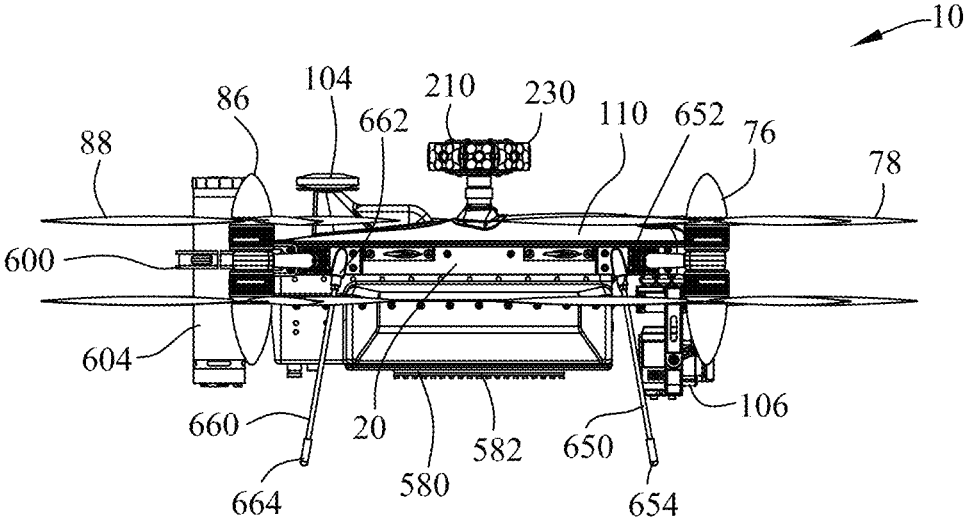
FIG. 8 is a left side view of FIG. 1.
Figure 9:
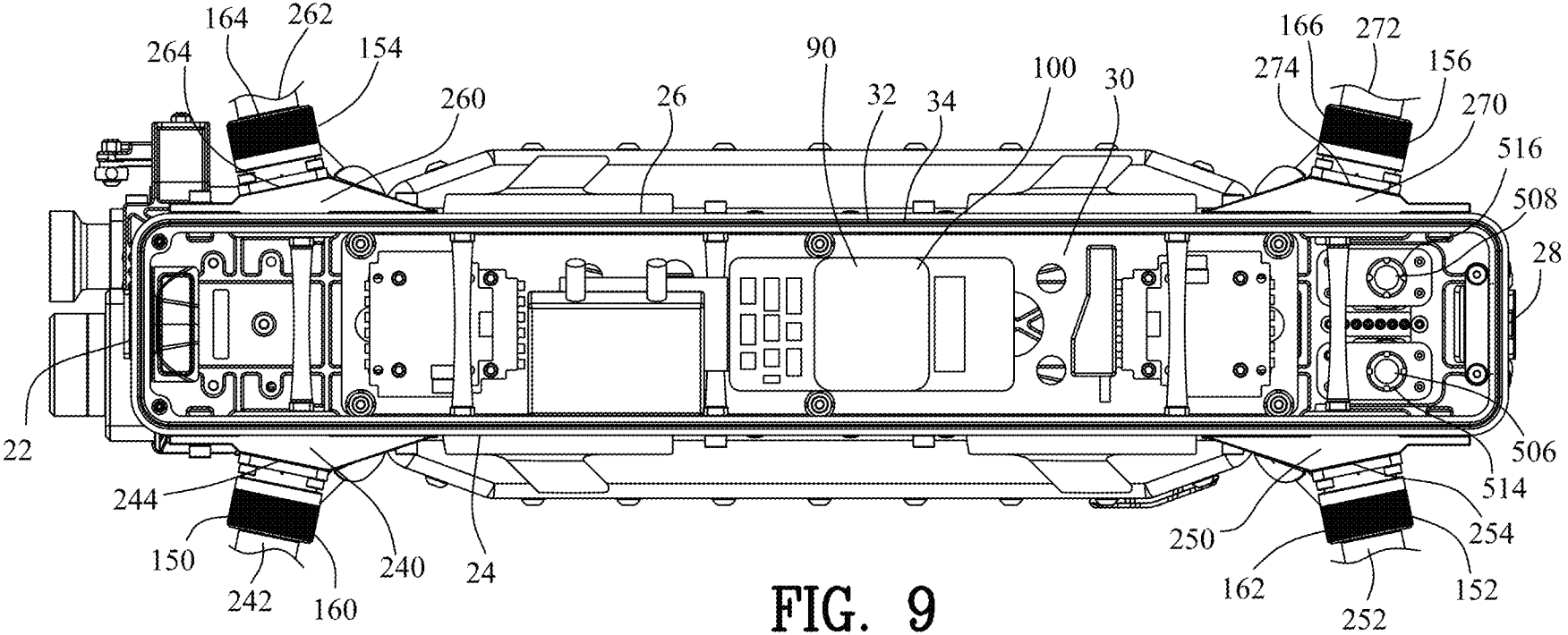
FIG. 9 is a sectional view along line 9-9 in FIG. 3.
Figure 10:
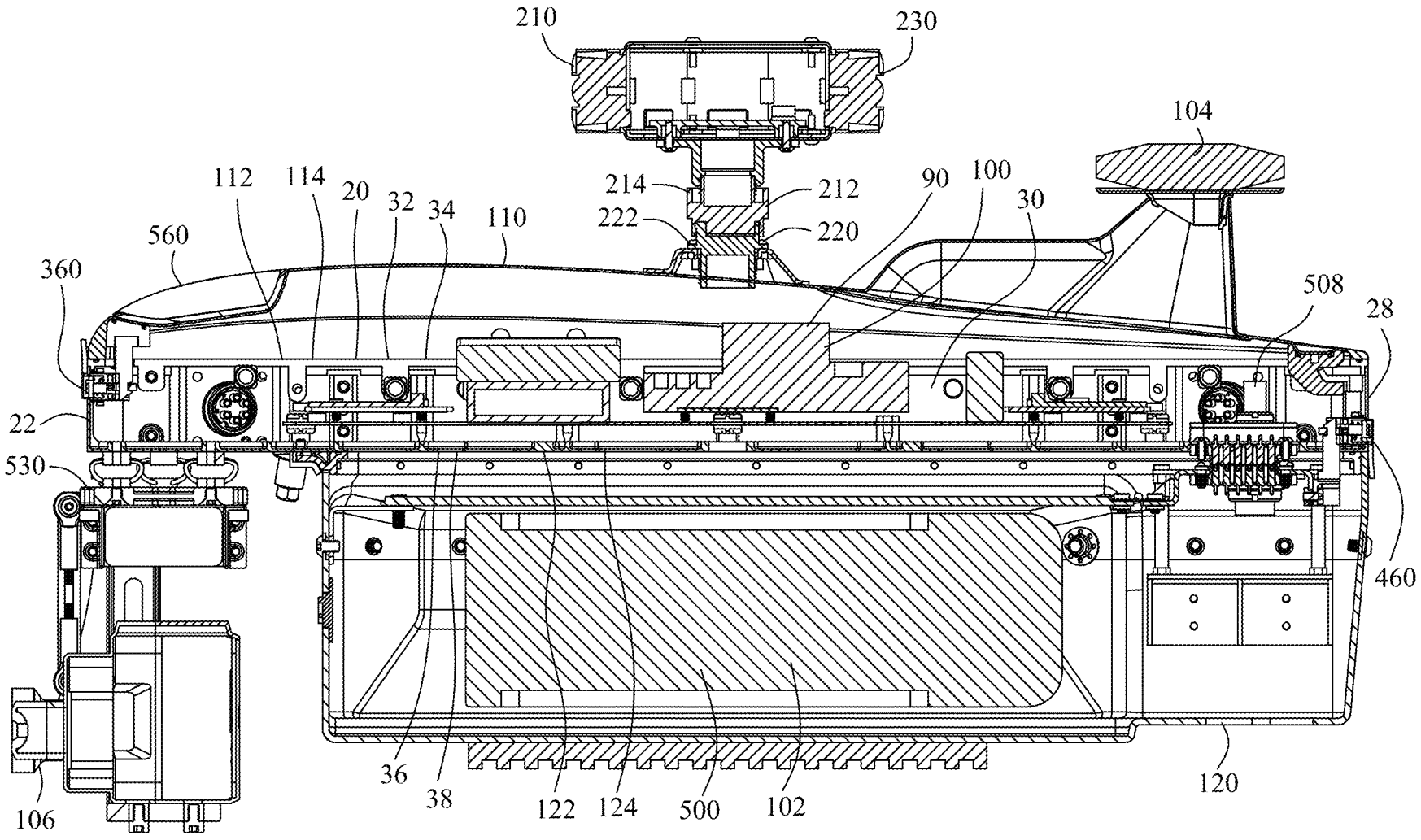
FIG. 10 is a sectional view along line 10-10 in FIG. 5.
Figure 11:
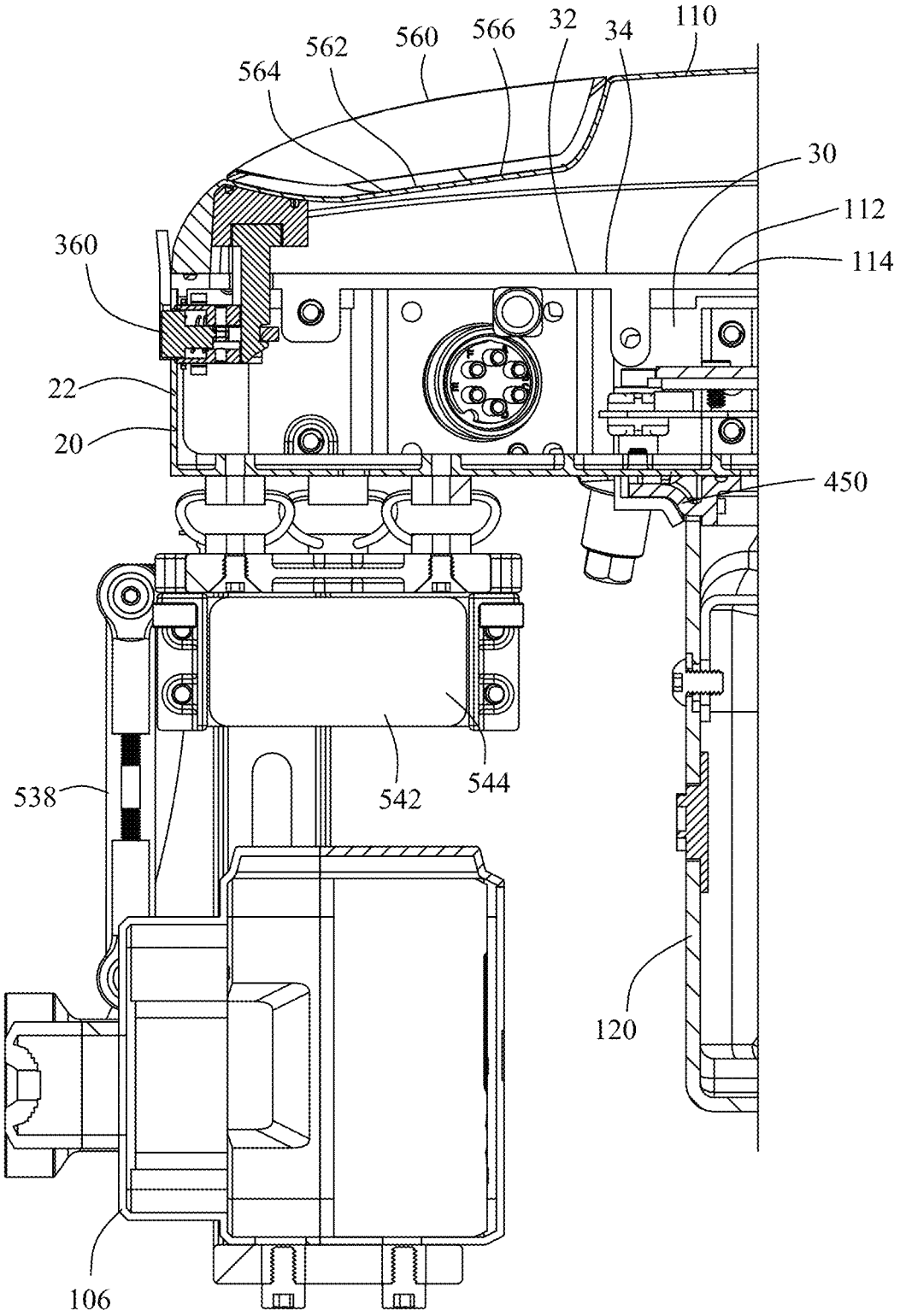
Figure 12:
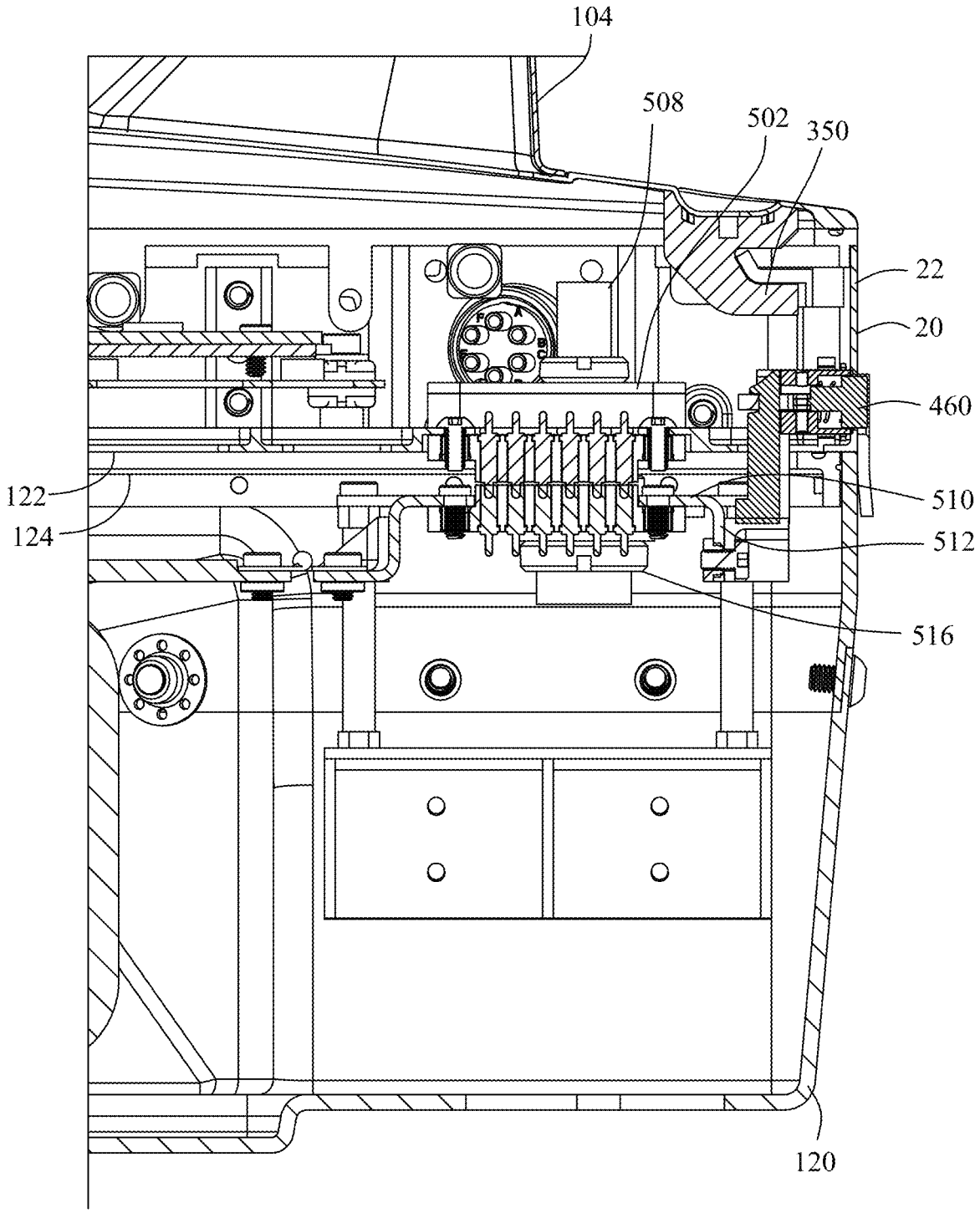
FIG. 12 is an enlarged portion of FIG. 10.
Figure 13:
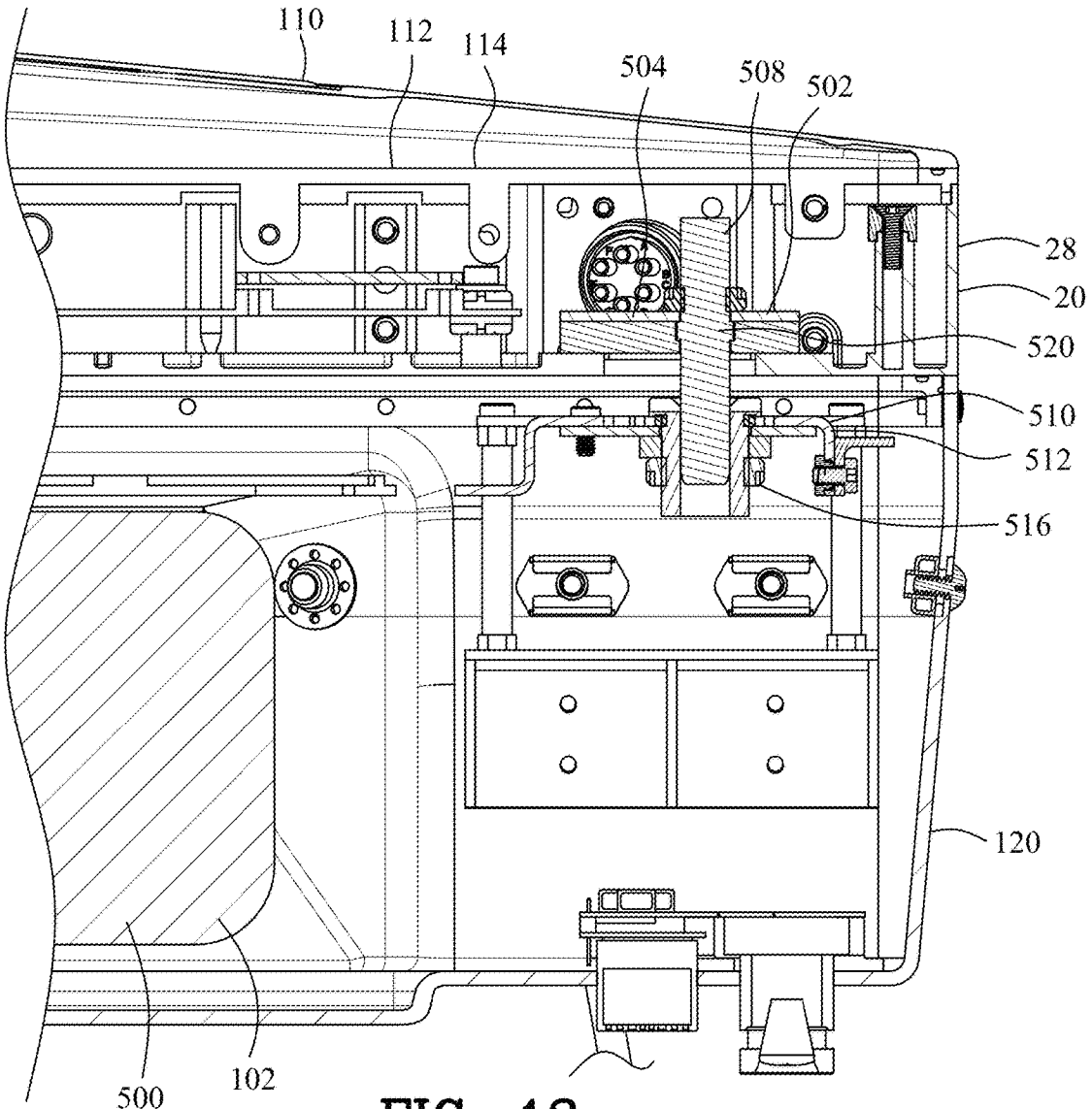
FIG. 13 is an sectional view along line 13-13 in FIG. 5.
Figure 14:
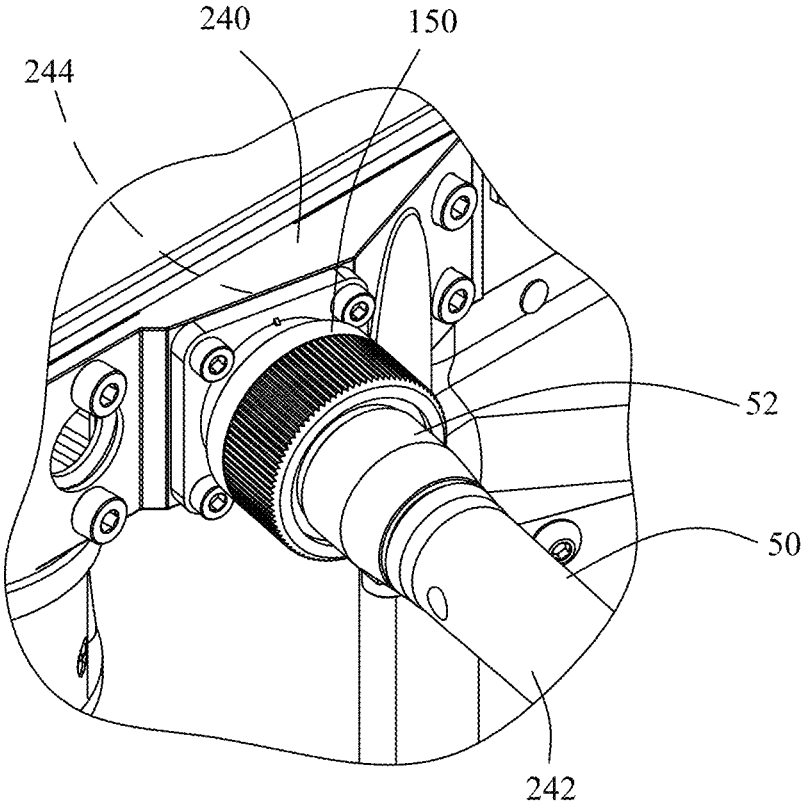
FIG. 14 is a right side isometric view of a portion of FIG. 1 illustrating a first boom coupled to the fuselage.
Figure 15:
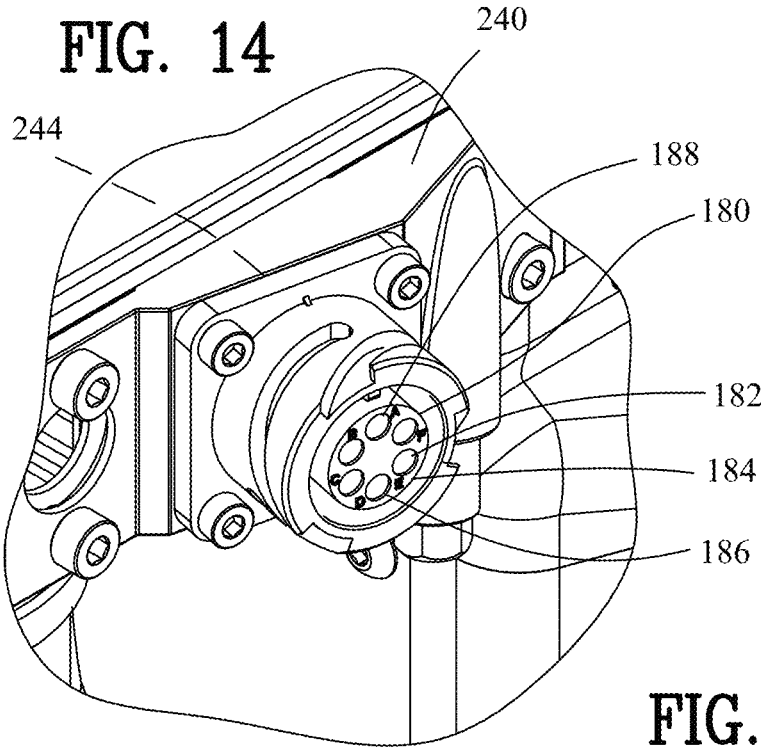
FIG. 15 is a view similar to FIG. 14 illustrating the first boom removed from the fuselage.
Figure 16:
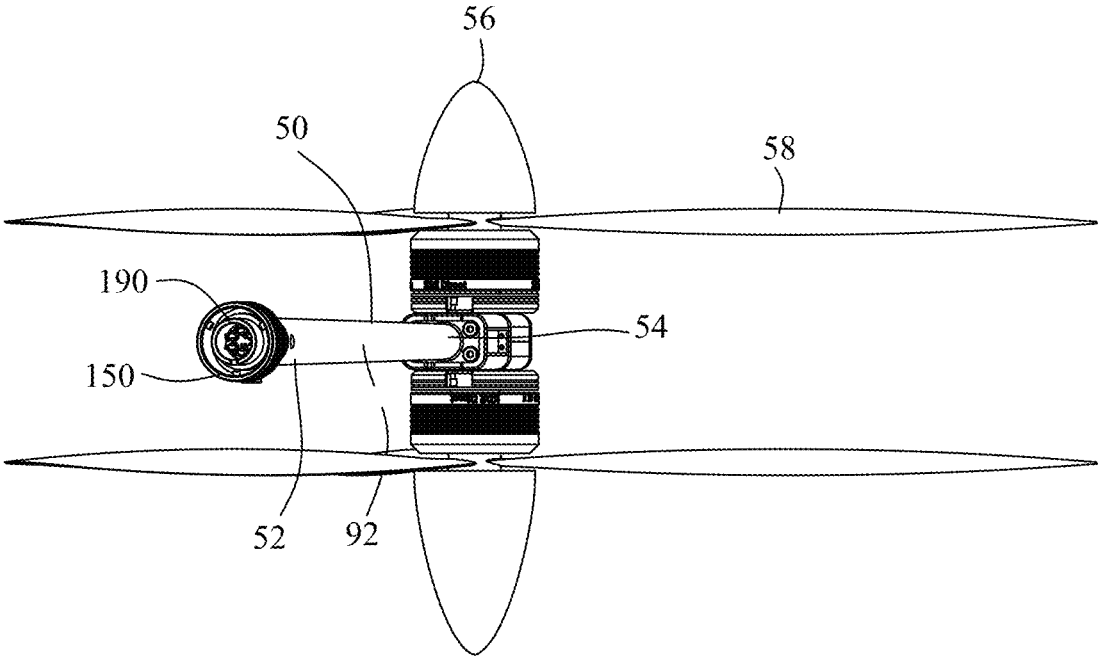
FIG. 16 is a side view of the first boom in FIG. 14 removed from the fuselage.
Figure 17:
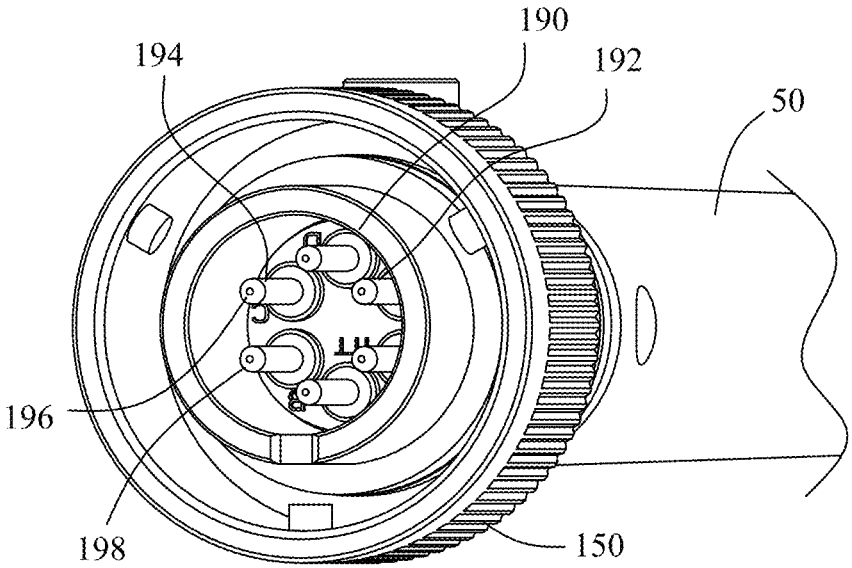
FIG. 17 is an enlarged portion of FIG. 16.
Figure 18:
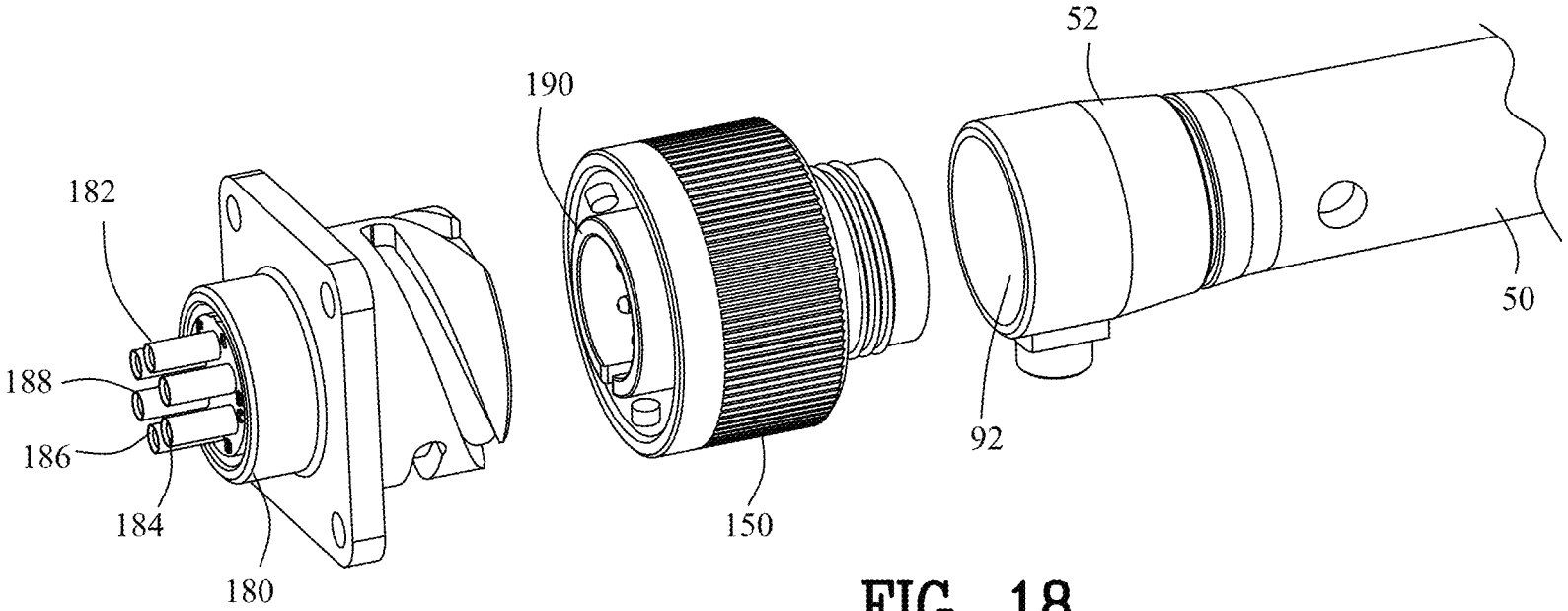
FIG. 18 is an exploded view of the first boom in FIG. 16.
Figure 19:
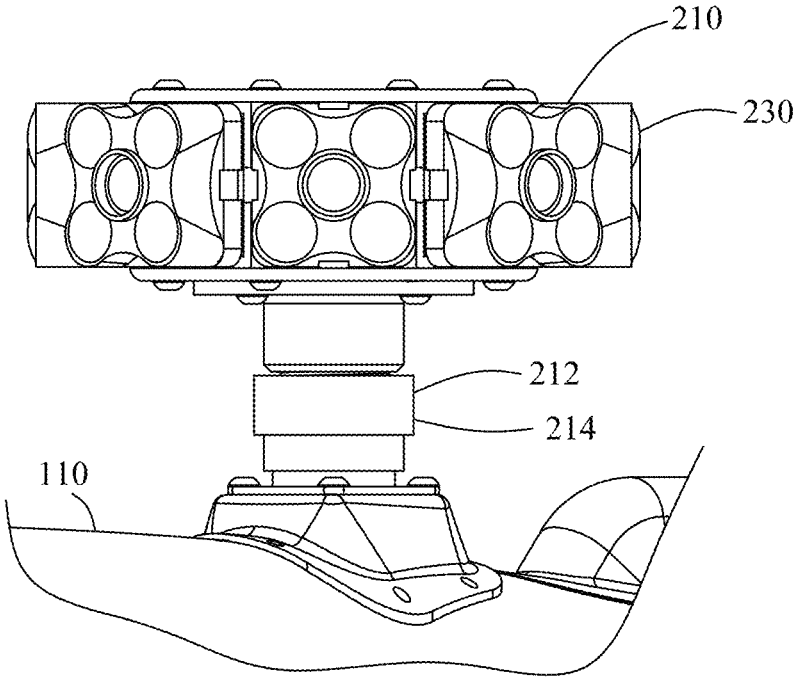
FIG. 19 is an enlarged portion of FIG. 7 illustrating an accessory device coupled to an upper cap.
Figure 20:
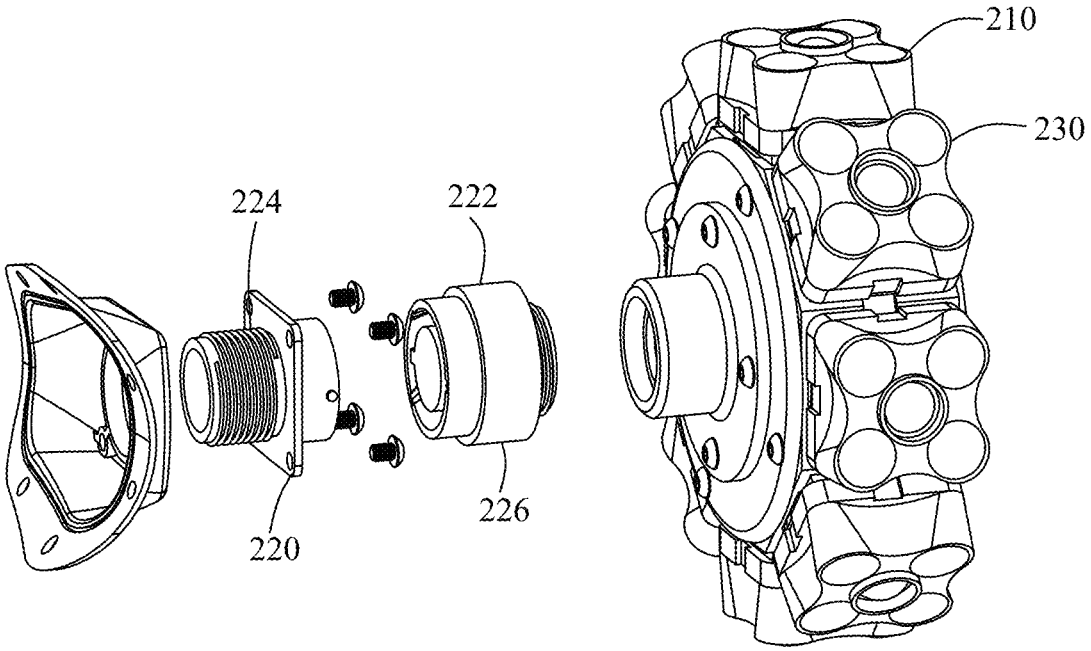
FIG. 20 is an exploded view of FIG. 19.
Figure 22:
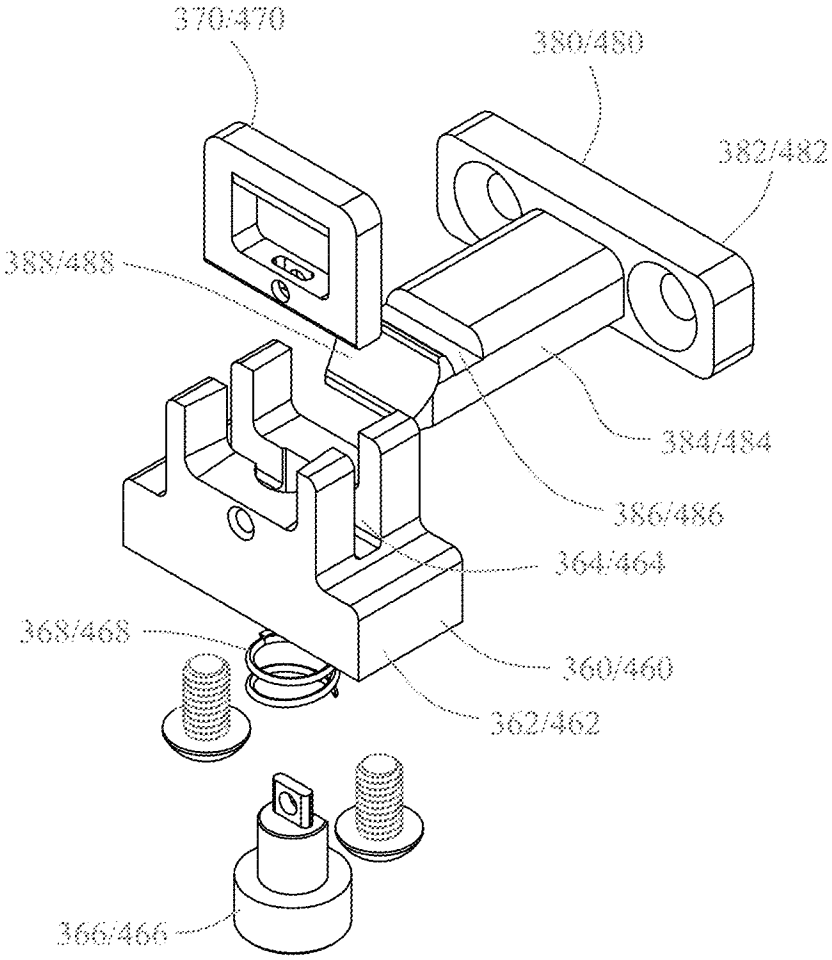
FIG. 22 is an exploded view of FIG. 21.
Figure 21:
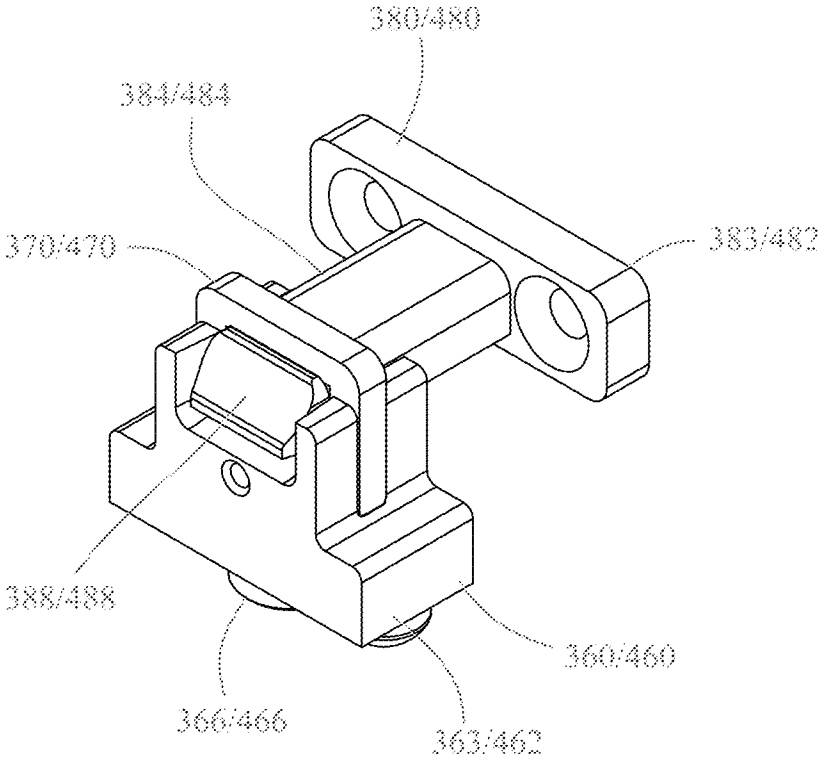
FIG. 21 is a front isometric view of a spring-loaded catch and a cap catch of FIGS. 11 and 12.
Figure 24:
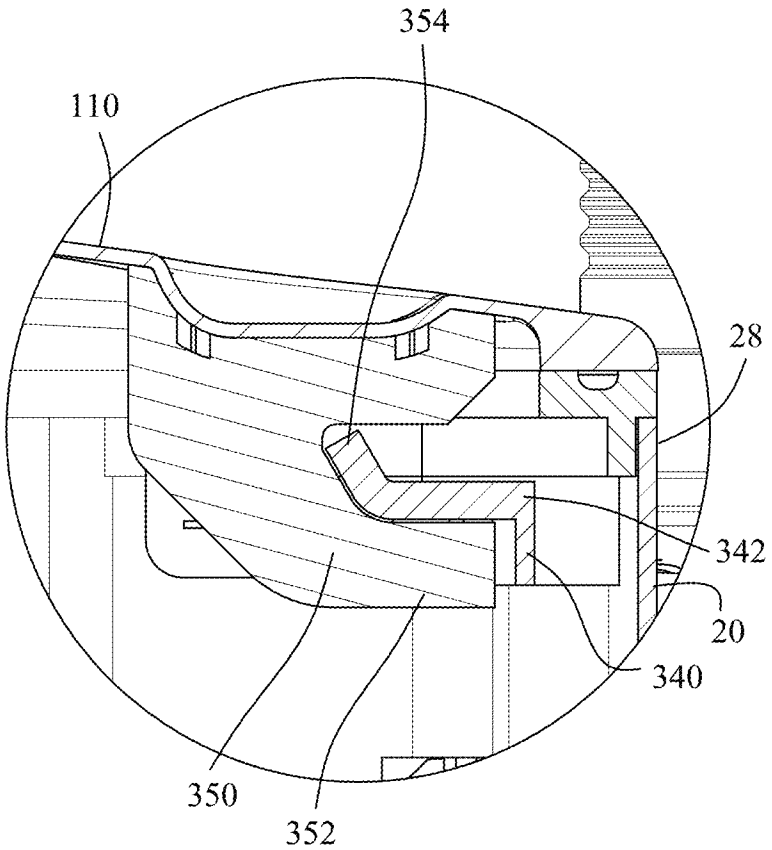
FIG. 24 is an enlarged portion of FIG. 12 illustrating an upper fuselage capture and an upper cap capture.
Figure 23:
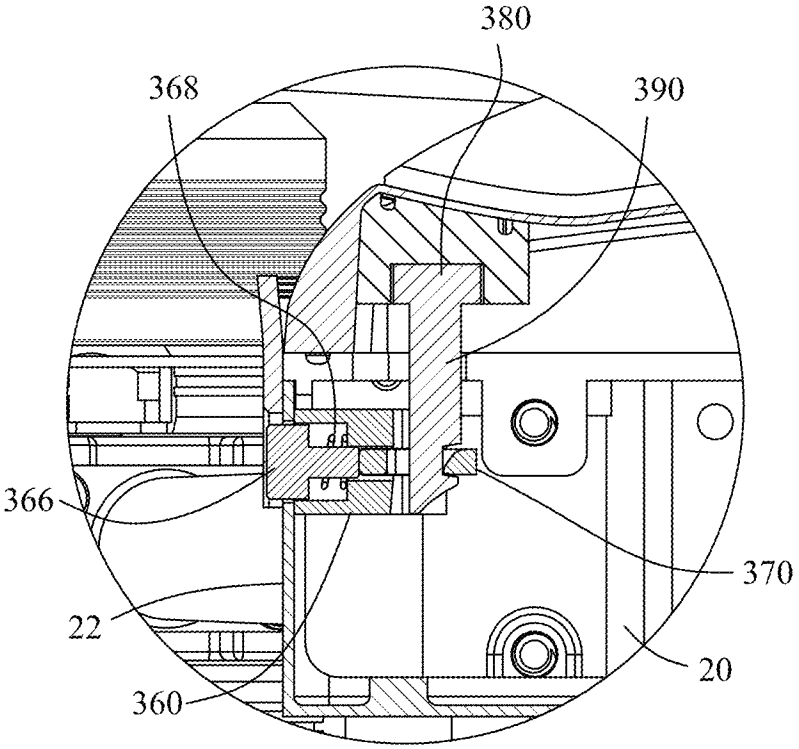
FIG. 23 is an enlarged portion of FIG. 1I illustrating an upper spring-loaded catch and an upper cap catch.
Figure 26:
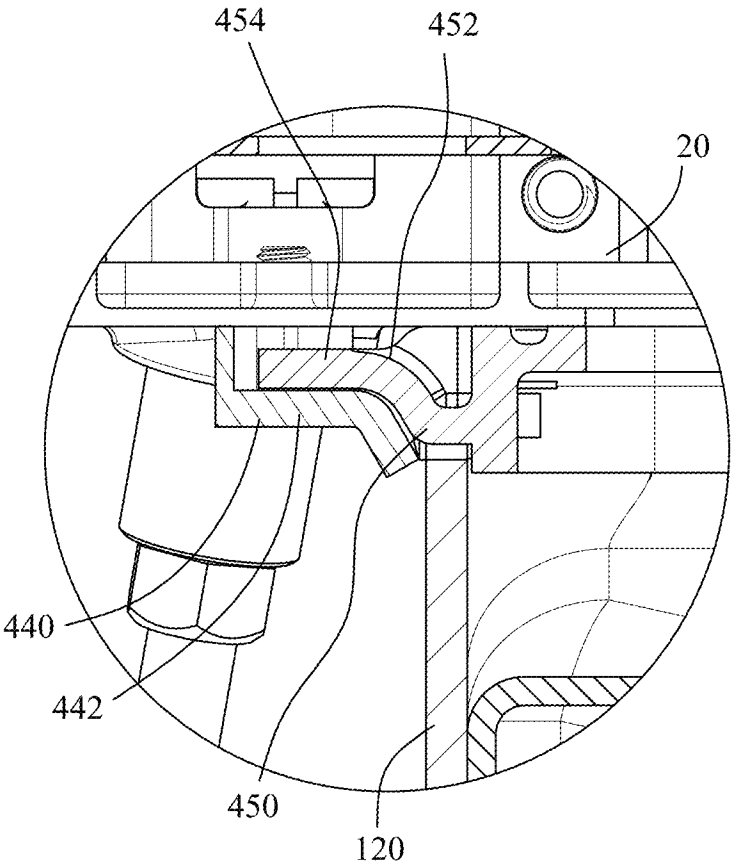
FIG. 26 is an enlarged portion of FIG. 12 illustrating a lower fuselage capture and a lower cap capture.
Figure 25:
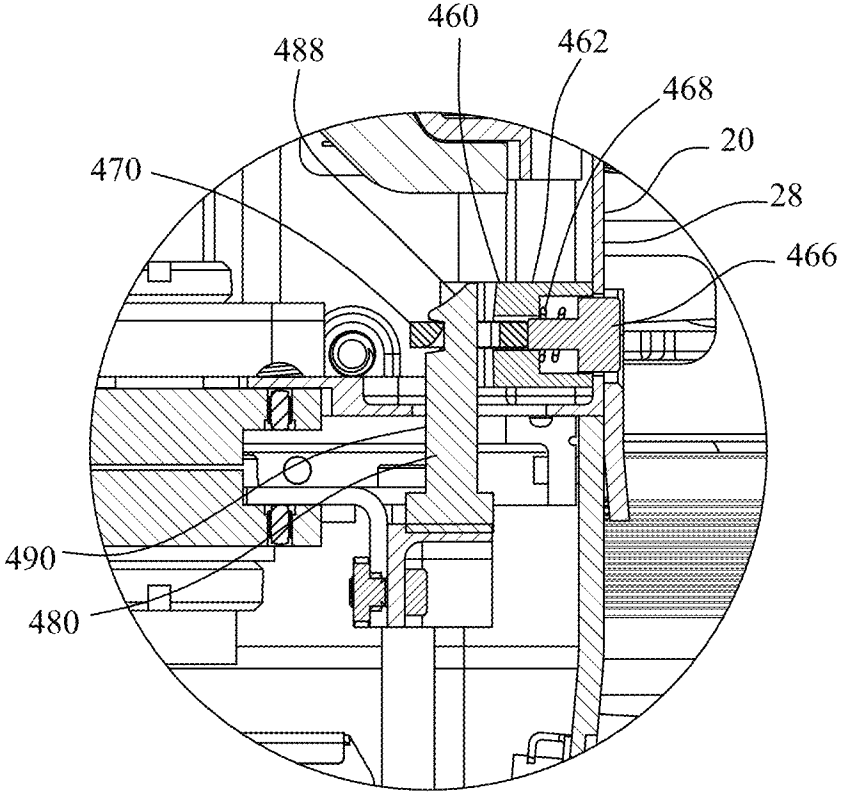
FIG. 25 is an enlarged portion of FIG. 1I illustrating a lower spring-loaded catch and a lower cap catch.

As best shown in FIGS. 21-22, the spring-operated catch mechanism includes at least a spring-operated catch 360 for coupling to a cap catch 380.

Preferably, the spring-operated catch 360 includes a catch base 362 for securing the spring-operated catch 360 to a structure or other device [not shown]. A catch channel 364 is within the base 362. A catch actuator 366 slidably engages within the catch channel 364. A spring 368 biases the catch actuator 366 into an engaging position. A pin receiver 370 is coupled to the catch actuator 366 for sliding into the catch channel 364.

Preferably, the cap catch 380 includes a mounting base 382 for coupling to the cap 110. A pin 384 is coupled to the mounting base 382 and includes a pin groove 386 and a pin tapered surface 388. The cap catch 380 engages with the spring-operated catch 360 for defining a cap fastener 390.

The catch actuator 366 is depressed for separating the spring-loaded catch 360 from the cap catch 380.

More specifically, the catch actuator 366 is depressed for displacing the pin receiver 370 wherein the pin receiver 370 is removed from the pin groove 386 for permitting the removal of the pin 384 from the pin receiver 370.

The pin receiver 370 includes a central aperture 370*a*, a pin receiver first surface 370*b*, and a pin receiver second surface 370*c*.

Pin (384) extends through the pin receiver (370) to engage or disengage with the pin receiver (370), wherein the pin receiver (370) is positioned within the catch channel (364) and within the pin groove (386) during engagement with the pin (384) and the pin receiver (370) is positioned within the catch channel (364) and outside of the pin groove (386) during disengagement with the pin (384).

It is understood this inventor anticipates the instant invention can be applied to any structurally sufficient device and that changes to size and component shapes are anticipated. Further as well as duplicity of the number of spring-operated catch mechanisms used within a device or composite of devices is anticipated. Further, it is anticipated the instant device may be formed integral with other components as required for securing the components together.

Further, where fast attachment and release of components is required, the instant device can be applied, including in mobile devices as well as stationary devices.

It is understood this inventor anticipates the instant invention can be comprised of a variety of known material including, but not limited to plastic, paper, foam, natural materials, biodegradable materials, recyclable materials, metals, liquids, and tangible compounds as well as any matter in a permanent or transitory state.

Further this inventor anticipates the instant invention can be made of clear material, opaque material, textured material, or reactive material (sensitive to chemicals, light, temperature, pressure, distance, or time) or a variety of known materials including wood, rubber, metal, or plastic, as well as from any suitable combination of appropriate materials.

Further this inventor anticipates the instant invention can be made into a variety of shapes beyond the shapes provided in the Figures.

The foregoing disclosure is sufficient to enable one having skill in the art to practice the apparatus without undue experimentation, and provides the best mode of practicing the apparatus presently contemplated by the inventor. While there is provided herein a full and complete disclosure of the preferred embodiments of this apparatus, it is not intended to limit the apparatus to the exact construction, dimensional relationships, and operation shown and described. Various modifications, alternative constructions, changes and equivalents will readily occur to those skilled in the art and may be employed, as suitable, without departing from the true spirit and scope of the apparatus. Such changes might involve alternative materials, components, structural arrangements, sizes, shapes, forms, functions, operational features or the like.

Accordingly, the proper scope of the present apparatus should be determined only by the broadest interpretation of the appended claims so as to encompass all such modifications as well as all relationships equivalent to those illustrated in the drawings and described in the specification.

FIGS. 1-36 illustrate an unmanned aerial vehicle 10 comprises a fuselage 20 defining a front wall 22, a primary side wall 24, a secondary side wall 26 and a rear wall 28. A fuselage chamber 30 is defined within the fuselage 20. An upper fuselage perimeter edge 32 is defined by the front wall 22, the primary side wall 24, the secondary side wall 26 and the rear wall 28. An upper aperture 34 is defined by the upper perimeter edge 32. A lower fuselage perimeter edge 36 is defined by the front wall 22, the primary side wall 24, the secondary side wall 26 and the rear wall 28. A lower aperture 38 is defined by the lower perimeter edge 36. Preferably, the fuselage 20 is constructed from an elongated flat plate configuration forming a rectangle body. One or more cross members may extend and be coupled to the interior of the rectangle body. The fuselage 20 may be constructed of a metallic, carbon fiber, polymeric or other materials.

A first boom 50 extends between a proximal end 52 and a distal end 54. The proximal end 52 of the first boom 50 is coupled to the primary side wall 24. A first rotor lift assembly 56 is coupled to the distal end 54 of the first boom 50 for providing a first lifting force 58. A second boom 60 extends between a proximal end 62 and a distal end 64. The proximal end 62 of the second boom 60 is coupled to the primary side wall 24. A second rotor lift assembly 66 is coupled to the distal end 64 of the second boom 60 for providing a second lifting force 68. A third boom 70 extends between a proximal end 72 and a distal end 74. The proximal end 72 of the third boom 70 is coupled to the secondary side wall 26. A third rotor lift assembly 76 is coupled to the distal end 74 of the third boom 70 for providing a third lifting force 78. A fourth boom 80 extends between a proximal end 82 and a distal end 84. The proximal end 82 of the fourth boom 80 is coupled to the secondary side wall 26. A fourth rotor lift assembly 86 is coupled to the distal end 84 of the fourth boom 80 for providing a fourth lifting force 88.

An electronic controller system 90 is within the fuselage chamber 30 and operates the first rotor lift assembly 56, the second rotor lift assembly 66, the third rotor lift assembly 76 and the fourth rotor lift assembly 86. A first electrical conduit 92 transverses within the first boom 50 and electrically couples the electronic controller system 90 to the first rotor lift assembly 56. A second electrical conduit 94 transverses within the second boom 60 and electrically couples the electronic controller system 90 to the second rotor lift assembly 66. A third electrical conduit 96 transverses within the third boom 70 and electrically couples the electronic controller system 90 to the third rotor lift assembly 76. A fourth electrical conduit 98 transverses within the fourth boom 80 and electrically couples the electronic controller system 90 to the fourth rotor lift assembly 86.

An upper cap 110 defines an upper cap perimeter edge 112. The upper cap perimeter edge 112 abuts the upper fuselage perimeter edge 32 for coupling the upper cap 110 within the fuselage 20 and may define an upper seal 114. The upper cap 110 may be configured for storing the antenna 104. In addition, the upper cap 110 may include an antenna body for housing the antenna 104 within. The upper cap 110 may be constructed of a metallic, carbon fiber, polymeric or other materials. Furthermore, the upper cap 110 may be constructed of a discontinuous carbon fiber, dyneema fiber, innegra fiber, core glass fabric or other composite material.

A lower cap 120 defines a lower cap perimeter edge 122. The lower cap perimeter edge 122 abuts the lower fuselage perimeter edge 36 for coupling the lower cap 120 within the fuselage 2020 and may define a lower seal 124. The lower cap 120 may be configured for storing the battery 102. The lower cap 120 may further receive a camera 106. The lower cap 120 may be constructed of a metallic, carbon fiber, polymeric or other materials. Furthermore, the lower cap 120 may be constructed of a discontinuous carbon fiber, dyneema fiber, innegra fiber, core glass fabric or other composite material. An electrical circuit 100 electrically couples the electrical components within the unmanned aerial vehicle 10.

The upper seal 114 may be positioned between the upper cap perimeter edge 112 and the upper fuselage perimeter edge 32 for sealing the coupling between the upper cap 110 and the fuselage 20. The lower seal 124 may be positioned between the lower cap perimeter edge 122 and the lower fuselage perimeter edge 36 for sealing the coupling between the lower cap 120 and the fuselage 20.

A reinforcing bracket may be coupled to the upper fuselage perimeter edge 32 for increasing the strength of the fuselage and increasing the contact area between the fuselage 20 and the upper cap 110. Similarly, a reinforcing bracket may be coupled to the lower fuselage perimeter edge 36 for increasing the strength of the fuselage and increasing the contact area between the fuselage 20 and the lower cap 120. The reinforcing bracket may include a O-ring groove for receiving the upper seal 114 and the lower seal 124.

The unmanned aerial vehicle 10 may include a first lock connector 150 for removeably couping the proximal end 52 of the first boom 50 with the fuselage 20. A second lock connector 152 removeably couples the proximal end 62 of the second boom 60 with the fuselage 20. A third lock connector 154 removeably couples the proximal end 72 of the third boom 70 with the fuselage 20. A fourth lock connector 156 removeably couples the proximal end 82 of the fourth boom 80 with the fuselage 20. The first lock connector 150, second lock connector 152, third lock connector 154 and the fourth lock connector 156 may include but not limited to a push pull connector 160, a twist lock connector 162, a snap pin connector 164, a pin out connector 166 or other connection structures. The first lock connector 150, second lock connector 152, third lock connector 154 and the fourth lock connector 156 permit the expedited removal of the first boom 50, the second boom 60, the third boom 70 and the fourth boom 80 from the fuselage 20 such that the unmanned aerial vehicle 10 may be more easily transported, repaired if one boom becomes damaged or one rotor lift assembly is damaged and provides various options of interchanging the size of the rotor lift assembly.

The unmanned aerial vehicle 10 may further include a primary electrical couple 180 and a secondary electrical couple 190 interior to the first lock connector 150 for removeably coupling the first electrical conduit 92 or 182 extending between the first rotor lift assembly 56 and the electronic controller system 90 during the first lock connector 150 removeably coupling the proximal end 52 of the first boom 50 with the fuselage 20. Similarly, a primary electrical couple 180 and a secondary electrical couple 190 are interior to the second lock connector 152 for removeably coupling a second electrical conduit 94 or 192 extending between the second rotor lift assembly 66 and the electronic controller system 90 during the second lock connector 152 removeably coupling the proximal end 62 of the second boom 60 with the fuselage 20. A primary electrical couple 180 and a secondary electrical couple 190 are interior to the third lock connector 154 for removeably coupling a third electrical conduit 96 or 182 extending between the third rotor lift assembly 76 and the electronic controller system 90 during the third lock connector 154 removeably coupling the proximal end 72 of the third boom 70 with the fuselage 20. A primary electrical couple 180 and a secondary electrical couple 190 are interior to the fourth lock connector 156 for removeably coupling a fourth electrical conduit 98 or 192 extending between the fourth rotor lift assembly 86 and the electronic controller system 90 during the fourth lock connector 156 removeably coupling the proximal end 82 of the fourth boom 80 with the fuselage 20.

The primary electrical couple 180 may include but not limited to an electrical socket 184, an electrical pin 186, an electrical conducting surface 188 or other contacting structures. The secondary electrical couple 190 may include but not limited to an electrical socket 194, an electrical pin 196, an electrical conducting surface 198 or other contacting structures. The interface between the primary electrical couple 180 and the secondary electrical couple 190 may be a friction engagement, compression engagement by a spring, mechanical structure or other compressive structures.

The unmanned aerial vehicle 10 may further including an accessory device 210 having a base 212. The base 212 of the accessory device 210 is coupled to the fuselage 20. Alternatively, the base 212 of the accessory device 210 may be coupled to the upper cap 110. In addition, the base 212 of the accessory device 210 may be coupled to the lower cap 120. An accessory lock connector 214 removeably couples the base 212 of the accessory device 210 with the fuselage 20, the upper cap 110 or the lower cap 120. A primary electrical couple 220 and a secondary electrical couple 222 are interior to the accessory lock connector 214 for removeably coupling an accessory electrical conduit into a primary electrical conduit 224 and a secondary electrical conduit 226 during the accessory lock connector 214 removeably coupling the base 212 of the accessory device 210 with the fuselage 20. As discussed above the primary electrical couple 220 may include but not limited to an electrical socket 184, an electrical pin 186, an electrical conducting surface 188 or other contacting structures. The secondary electrical couple 222 may include but not limited to an electrical socket 194, an electrical pin 196, an electrical conducting surface 198 or other contacting structures. The interface between the primary electrical couple 220 and the secondary electrical couple 222 may be a friction engagement, compression engagement by a spring, mechanical structure or other compressive structures. The accessory device 210 may include a 360° object avoidance tower 230, a speaker, a light emitting device, a laser, weapon, a microphone, a camera, a beacon, targeting system or other accessory devices.

The unmanned aerial vehicle 10 may further including a first angled member 240 between the fuselage 20 and the first boom 50 for defining a first non-perpendicular orientation 242 of the first boom 50 relative to the fuselage 20. The first angled member 240 preferably includes a first angled member aperture 244 for permitting the first electrical conduit 92 to traverse to the first boom 50. A second angled member 250 is between the fuselage 20 and the second boom 60 for defining a second non-perpendicular orientation 252 of the second boom 60 relative to the fuselage 20. The second angled member 250 preferably includes a second angled member aperture 254 for permitting the second electrical conduit 94 to traverse to the second boom 60. The first non-perpendicular orientation 242 and the second non-perpendicular orientation 252 distances the first rotor lift assembly 56 and the second rotor lift assembly 66 on a first side of the fuselage 20 for permitting increased sized the first rotor lift assembly 56 and the second rotor lift assembly 66.

A third angled member 260 is between the fuselage 20 and the third boom 70 for defining a third non-perpendicular orientation 262 of the third boom 70 relative to the fuselage 20. The third angled member 260 preferably includes a third angled member aperture 264 for permitting the third electrical conduit 96 to traverse to the third boom 70. A fourth angled member 270 is between the fuselage 20 and the fourth boom 80 for defining a fourth non-perpendicular orientation 272 of the fourth boom 80 relative to the fuselage 20. The fourth angled member 270 preferably includes a fourth angled member aperture 274 for permitting the fourth electrical conduit 98 to traverse to the fourth boom 80. The third non-perpendicular orientation 262 and the fourth non-perpendicular orientation 272 distances the third rotor lift assembly 76 and the fourth rotor lift assembly 86 on a second side of the fuselage 20 for permitting increased sized the third rotor lift assembly 76 and the fourth rotor lift assembly 86. Preferably, the first angled member 240, the second angled member 250, the third angled member 260 and the fourth angled member 270 are interior and adjacent to the first lock connector 150, the second lock connector 152, the third lock connector 154 and the fourth lock connector 156 respectively.

Figure 32:
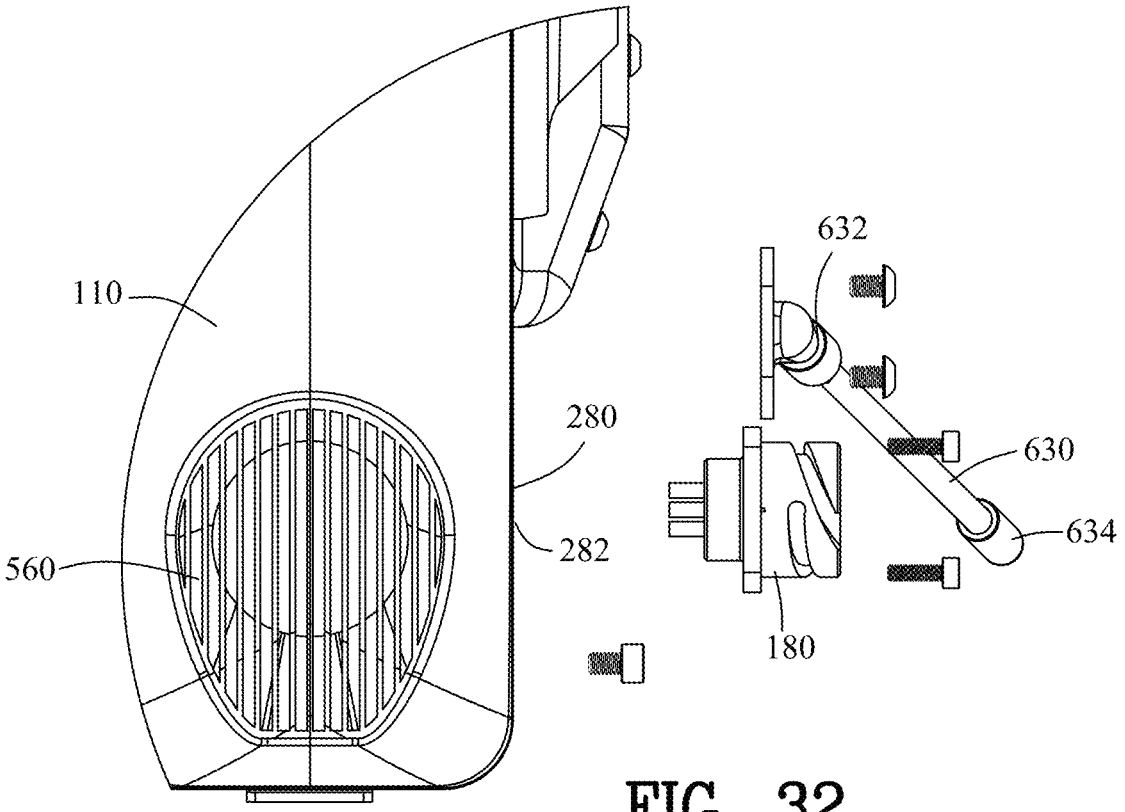
FIG. 32 is a view similar to FIG. 31 illustrating the first lock connector positioned to be reinstalled to the fuselage without the first angled member.
Figure 33:
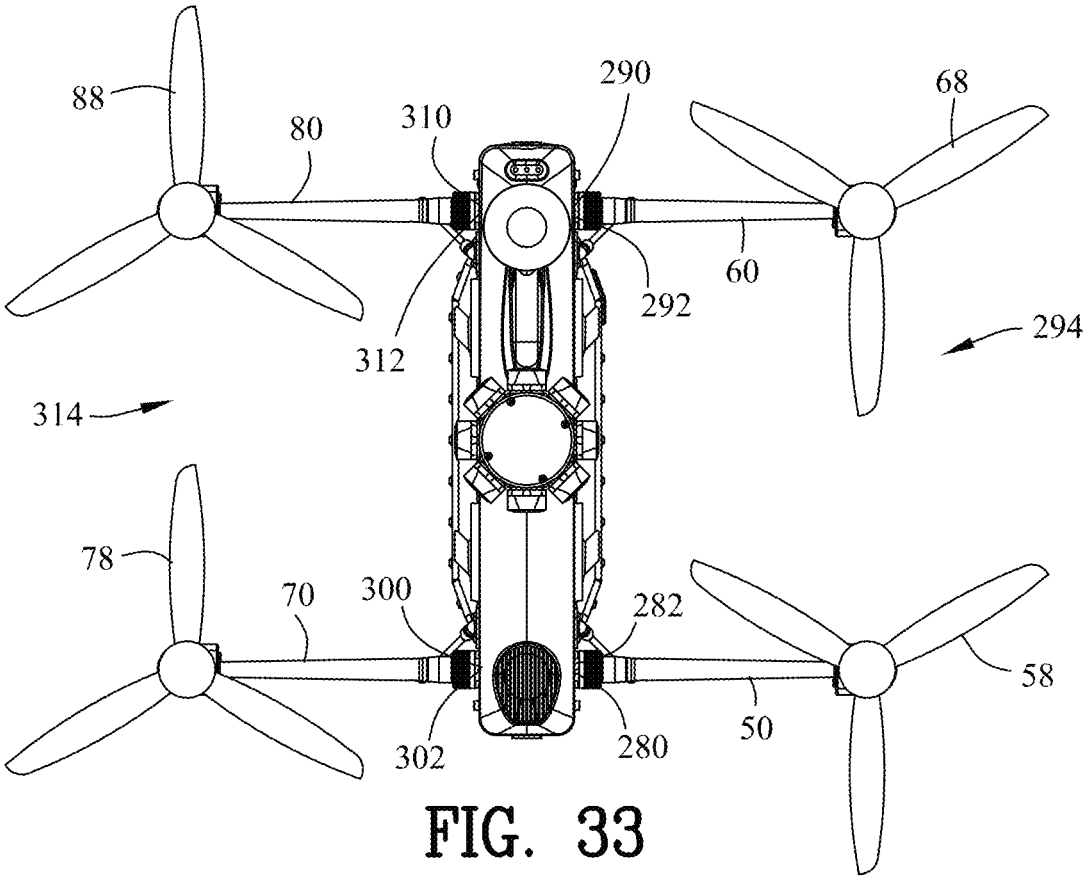
FIG. 33 is a view of the first, second, third and fourth boom reinstalled with the fuselage without a first, second, third or fourth angled member.
Figure 34:
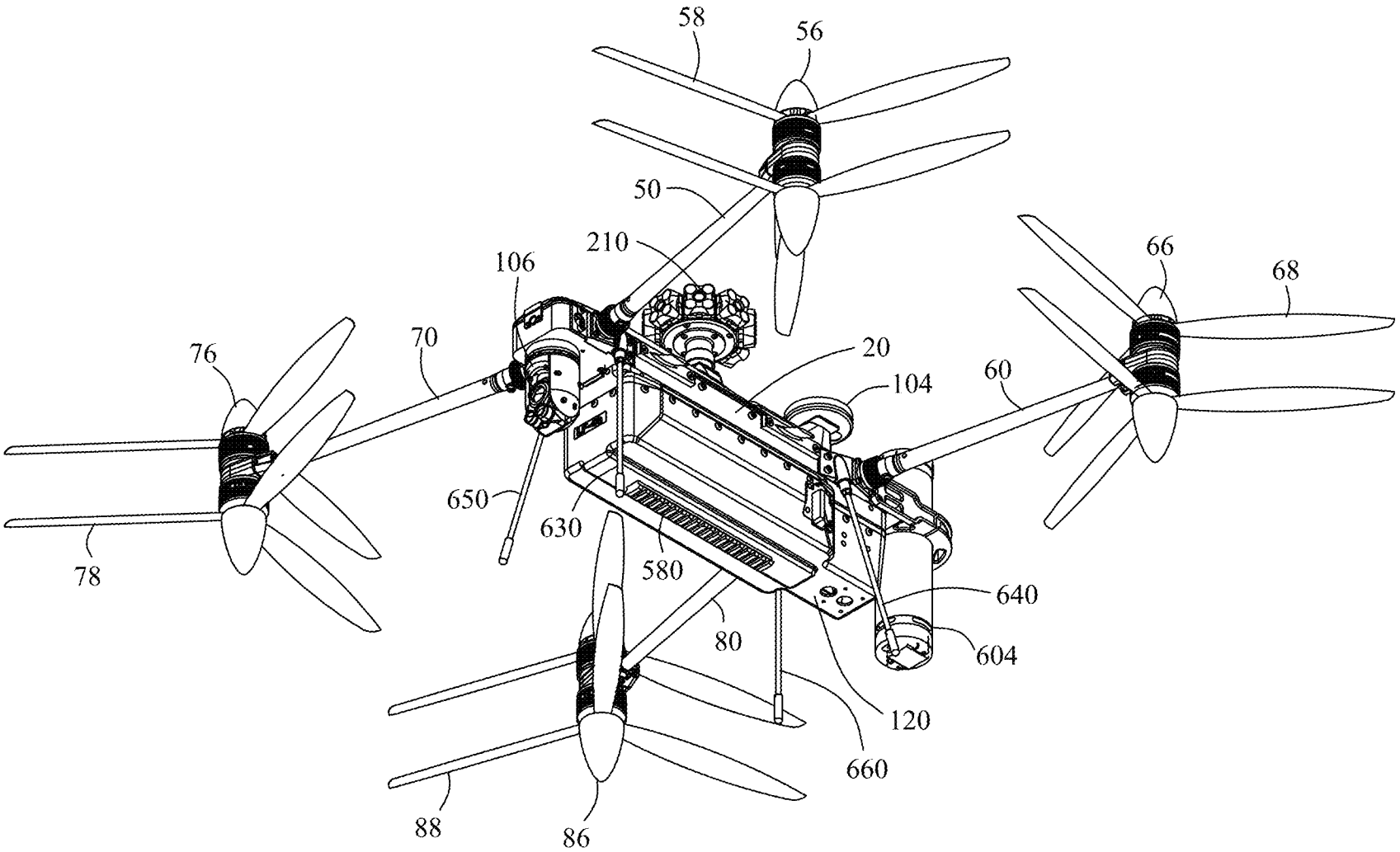
FIG. 34 is a front lower isometric view of the unmanned aerial vehicle in FIG. 1 with an alternative camera.
Figure 35:
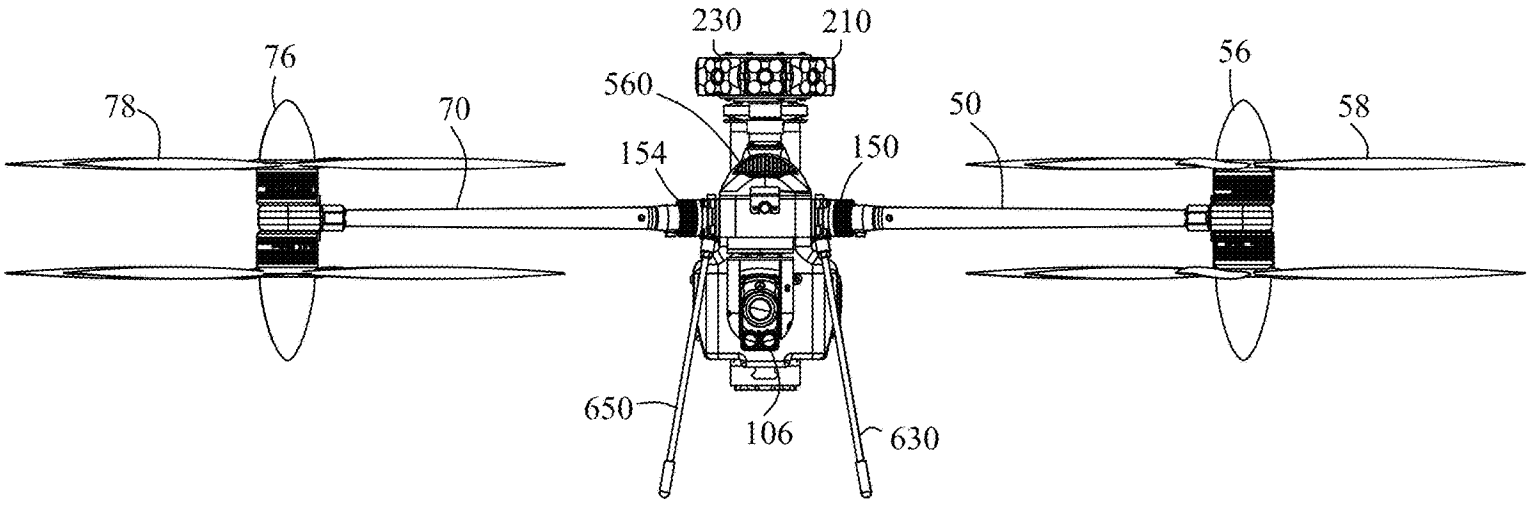
FIG. 35 is a front view of FIG. 34.
Figure 36:
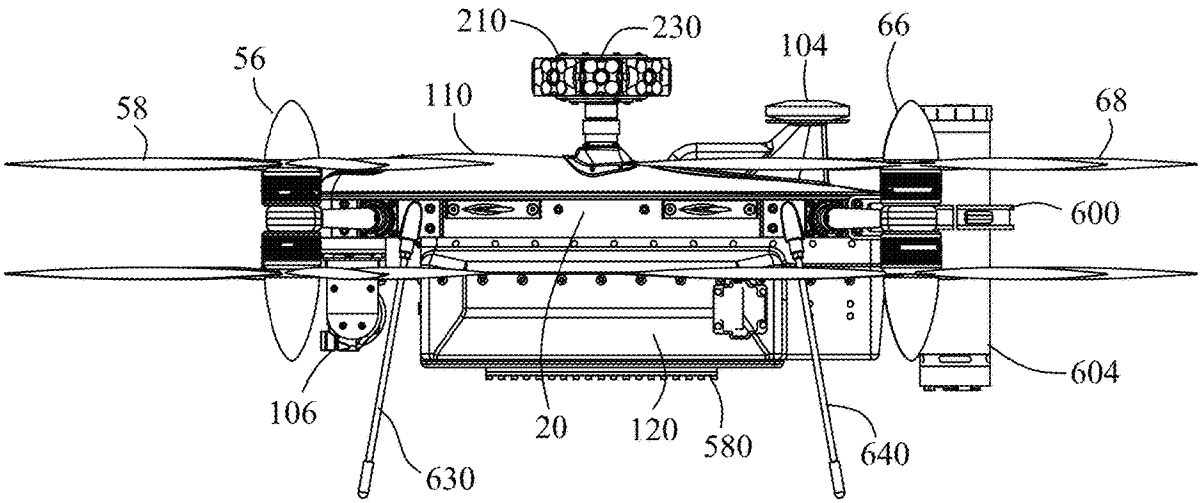
FIG. 36 is a right side view of FIG. 35.

As shown in FIGS. 32 and 33, the unmanned aerial vehicle 10 may further including a first non-angled member 280 between the fuselage 20 and the first boom 50 for defining a first perpendicular orientation of the first boom 50 relative to the fuselage 20. The first non-angled member 280 may be defined by the fuselage 20 or a spacer member coupled to the fuselage 20. A first fuselage aperture 282 within the fuselage 20 or the spacer member permits the first electrical conduit 92 to traverse to the first boom 50. A second non-angled member 290 is between the fuselage 20 and the second boom 60 for defining a second perpendicular orientation of the second boom 60 relative to the fuselage 20. A second fuselage aperture 292 within the fuselage 20 or the spacer member permits the second electrical conduit 94 to traverse to the second boom 60. The first perpendicular orientation and the second perpendicular orientation define a primary parallel orientation 294 relative to the first rotor lift assembly 56 and the second rotor lift assembly 66 on a first side of the fuselage 20 for permitting reduced sized first rotor lift assembly 56 and second rotor lift assembly 66.

A third non-angled member 300 is between the fuselage 20 and the third boom 70 for defining a third perpendicular orientation of the third boom 70 relative to the fuselage 20. The third non-angled member 300 may be defined by the fuselage 20 or a spacer member coupled to the fuselage 20. A third fuselage aperture 302 within the fuselage 20 or the spacer member permits the third electrical conduit 96 to traverse to the third boom 70. A fourth non-angled member 310 is between the fuselage 20 and the fourth boom 80 for defining a fourth perpendicular orientation of the fourth boom 80 relative to the fuselage 20. The fourth non-angled member 310 may be defined by the fuselage 20 or a spacer member coupled to the fuselage 20. A fourth fuselage aperture 312 within the fuselage 20 or the spacer member permits the fourth electrical conduit 98 to traverse to the fourth boom 80. The third perpendicular orientation and the fourth perpendicular orientation define a secondary parallel orientation 314 relative to the third rotor lift assembly 76 and the fourth rotor lift assembly 86 on a second side of the fuselage 20 for permitting reduced sized third rotor lift assembly 76 and fourth rotor lift assembly 86.

As best shown in FIGS. 10-12 and 21-26, the unmanned aerial vehicle 10 may further include an upper fuselage capture 340 coupled adjacent to the upper fuselage perimeter 32 of the fuselage 20. The upper fuselage capture 340 may include a mounting pin 342. An upper cap capture 350 is coupled adjacent to the upper cap perimeter 112 of the upper cap 110. The upper cap capture 350 may include a pin receiver 362. The upper cap capture 350 engages with the upper fuselage capture 340 for defining a primary upper cap fastener 354.

An upper spring-loaded catch 360 is coupled adjacent to the upper fuselage perimeter 32 of the fuselage 20. Preferably, the upper spring-loaded catch 360 includes a catch base 362 for securing the upper spring-loaded catch 360 to the fuselage 20. A catch channel 364 is within the base 362. An upper catch actuator 366 slidably engages within the catch channel 364. A spring 368 biases the upper catch actuator 366 into an engaging position. A pin receiver 370 is coupled to the upper catch actuator 366 for sliding into the catch channel 364.

An upper cap catch 380 is coupled adjacent to the upper cap perimeter 112 of the upper cap 110. Preferably, the upper cap catch 380 includes a mounting base 382 for coupling to the upper cap 110. A pin 384 is coupled to the mounting base 382 and includes a pin groove 386 and a pin tapered surface 388. The upper cap catch 380 engages with the upper spring-loaded catch 360 for defining a secondary upper cap fastener 390. The upper catch actuator 366 is depressed for separating the upper spring-loaded catch 360 from the upper cap catch 380. More specifically, the upper catch actuator 366 is depressed for displacing the pin receiver 370 wherein the pin receiver 370 is removed from the pin groove 386 for permitting the removal of the pin 384 from the pin receiver 370. The engagement between the primary upper fastener 354 and the secondary upper fastener 390 provide expedited removal and installation of the upper cap 110 with the fuselage 20. Furthermore, the engagement between the primary upper fastener 354 and the secondary upper fastener 390 provide a very strong and secure coupling between the upper cap 110 and the fuselage 20.

The unmanned aerial vehicle 10 may further include a lower fuselage capture 440 coupled adjacent to the lower fuselage perimeter 36 of the fuselage 20. The lower fuselage capture 440 may include a mounting pin 442. A lower cap capture 450 is coupled adjacent to the lower cap perimeter 122 of the lower cap 120. The lower cap capture 450 may include a pin receiver 452. The lower cap capture 450 engages with the lower fuselage capture 440 for defining a primary lower cap fastener 454.

A lower spring-loaded catch 460 is coupled adjacent to the lower fuselage perimeter 36 of the fuselage 20. Preferably, the lower spring-loaded catch 460 includes a catch base 462 for securing the lower spring-loaded catch 460 to the fuselage 20. A catch channel 464 is within the base 462. A lower catch actuator 466 slidably engages within the catch channel 464. A spring 468 biases the lower catch actuator 466 into an engaging position. A pin receiver 470 is coupled to the lower catch actuator 466 for sliding into the catch channel 464.

A lower cap catch 380 is coupled adjacent to the lower cap perimeter 122 of the lower cap 120. Preferably, the lower cap catch 480 includes a mounting base 482 for coupling to the lower cap 120. A pin 484 is coupled to the mounting base 482 and includes a pin groove 486 and a pin tapered surface 488. The lower cap catch 480 engages with the lower spring-loaded catch 460 for defining a secondary lower cap fastener 490. The lower catch actuator 466 is depressed for separating the lower spring-loaded catch 460 from the lower cap catch 480. More specifically, the lower catch actuator 466 is depressed for displacing the pin receiver 470 wherein the pin receiver 470 is removed from the pin groove 486 for permitting the removal of the pin 484 from the pin receiver 470. The engagement between the primary lower fastener 454 and the secondary lower fastener 490 provide expedited removal and installation of the lower cap 120 with the fuselage 20. Furthermore, the engagement between the primary lower fastener 454 and the secondary lower fastener 490 provide a very strong and secure coupling between the lower cap 120 and the fuselage 20.

As shown in FIGS. 9, 10, 12 and 13, an electrical current source 500 or battery 102 is positioned within the lower cap 120. A fuselage electrical terminal 502 is coupled to the fuselage 20 and is electrically coupled to the electronic controller system 90. The fuselage electrical terminal 502 may include an electrical plate 504 including a primary electrical pin 506 and a secondary electrical pin 508. A cap electrical terminal 510 is coupled to the lower cap 120 and is electrically coupled to the electrical current source 500 or 10. The cap electrical terminal 510 may include an electrical plate 512 having a primary electrical socket 514 and a secondary electrical socket 516. The fuselage electrical terminal 502 engages with the cap electrical terminal 510 for defining a main electrical connector 520 for removeably coupling the fuselage electrical terminal 502 with the cap electrical terminal 510 during the lower cap 120 removeably coupling with the fuselage 20.

Figure 27:
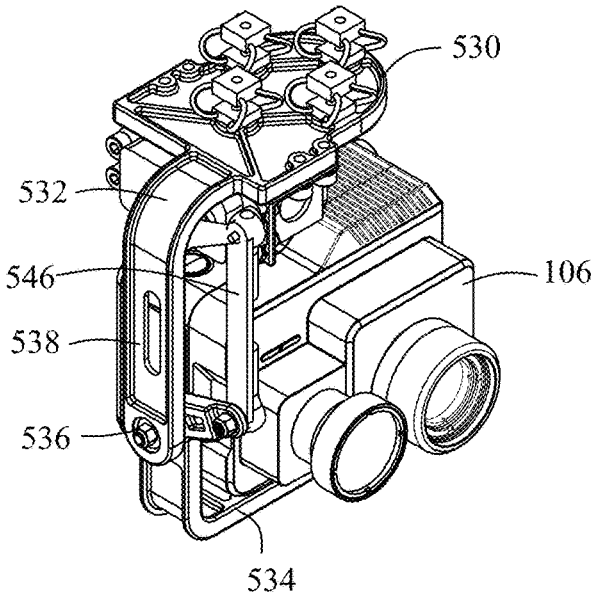
FIG. 27 is an enlarged portion of FIG. 1 illustrating a camera mount supporting a camera.
Figure 28:
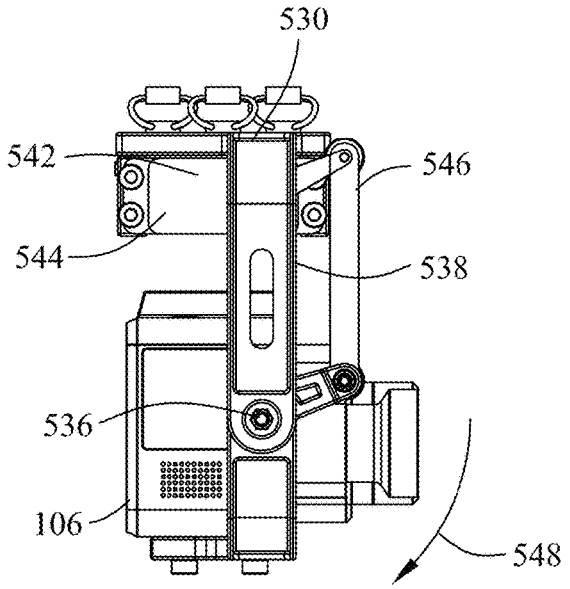
FIG. 28 is a left side view of FIG. 27.
Figure 29:
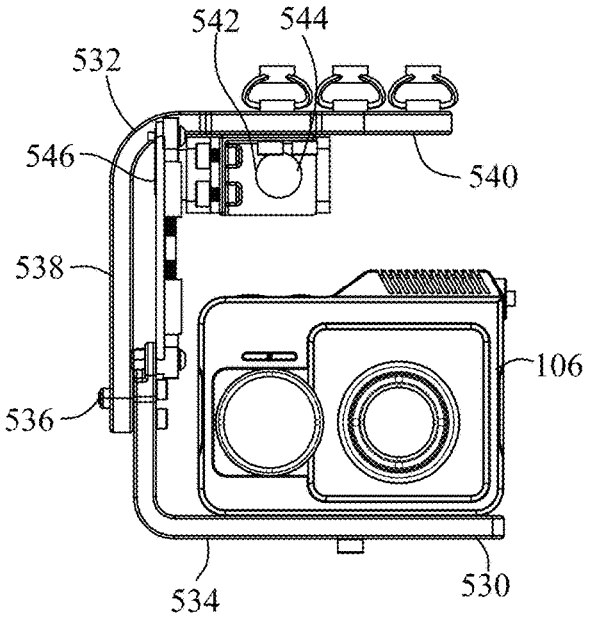
FIG. 29 is a front view of FIG. 27.
Figure 30:
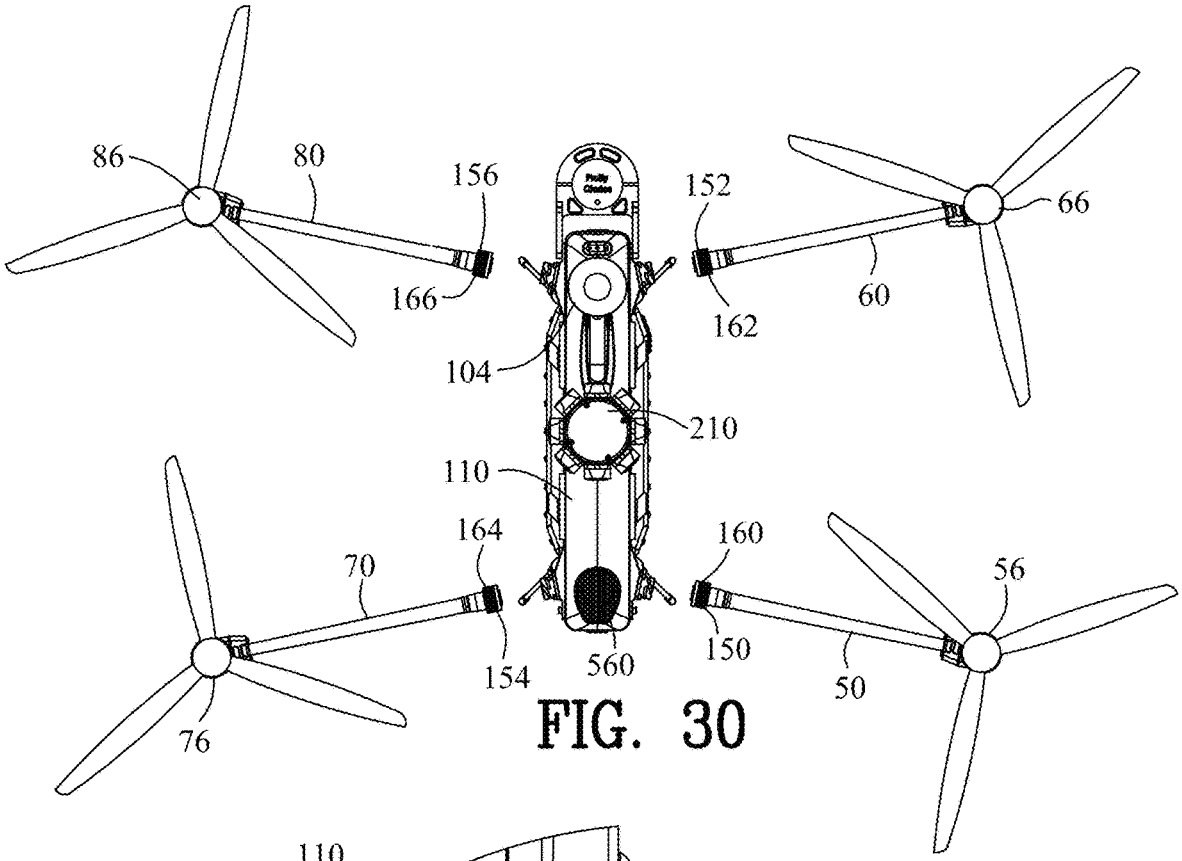
FIG. 30 is a view similar to FIG. 5 illustrating a first, second, third and fourth boom removed from the fuselage.
Figure 31:
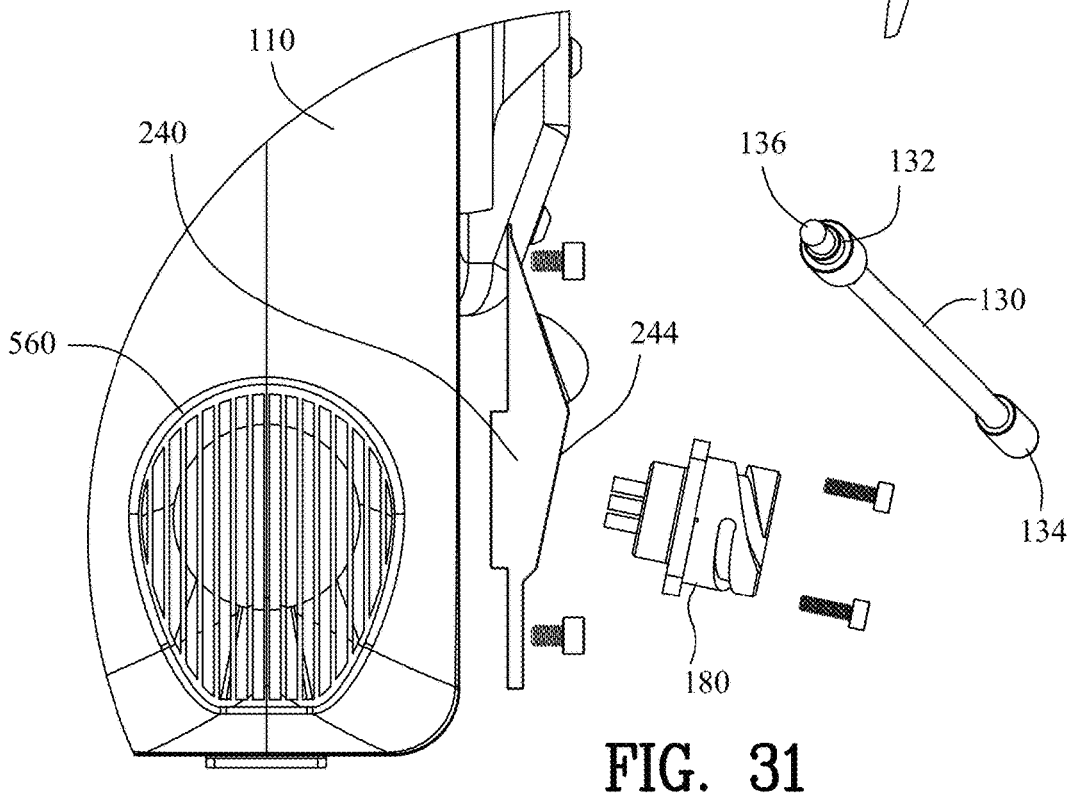
FIG. 31 is an enlarged portion of FIG. 30 illustrating a first leg, first lock connector and a first angled member removed from the fuselage.

As best shown in FIGS. 27-29, the unmanned aerial vehicle may further include a camera mount 530 having an upper mounting frame 532 and a lower mounting frame 534. A pivot 536 pivotably couples the upper mounting frame 532 with the lower mounting frame 534. The upper mounting frame 532 and the lower mounting frame 534 define a general U shaped frame 538 for defining a frame channel 540. The upper mounting frame 532 is coupled to the fuselage 20. A camera 106 is mounted to the lower mounting frame 534. A pivot actuator 542 is secured to the upper mounting frame 534 and is linked to the lower mounting frame 534 for rotating the lower mounting frame 534 and the camera 106 about the pivot 536 for adjusting the elevational orientation of the camera 106. The pivot actuator 542 may include a servo 544. An actuator arm 546 may be pivotably coupled to both the pivot actuator 542 and the lower mounting frame 534 for producing the rotational displacement 548 of the lower mounting frame 534.

Additional pivot actuators may be coupled to the upper mounting frame 534 in order to rotate the lower mounting frame 534 in a vertical axis orientation or direction for providing a left or right displacement of the camera 106. One or more wire rope isolators maybe used for coupling the upper mounting frame 532 to the fuselage 20. The one or more wire rope isolators assist in minimizing vibration from the fuselage 20 being transferred to the camera mount 530 and into the camera 106. As such the one or more wire rope isolators improves the video image produced by the camera 106. Alternatively, other vibration of medication devices may be used between the camera mount 530 and the fuselage 20.

As best shown in FIGS. 1, 5, 10 and 11, the unmanned aerial vehicle 10 may further include a heat sink 560 positioned exterior to the upper cap 110. A fuselage thermal terminal 562 is coupled to the fuselage 20 and is thermally coupled to the electronic controller system 90. A cap thermal terminal 564 is coupled to the upper cap 110 and is thermally coupled to the heat sink 560. The fuselage thermal terminal 562 engages with the cap thermal terminal 564 for defining a main thermal connector 566 for removeably coupling the fuselage thermal terminal 562 with the cap thermal terminal 564 during the upper cap 110 removeably coupling with the fuselage 20. The fuselage thermal terminal 562 and the cap thermal terminal 564 may include a pin and socket thermal connection, a thermal conducting surface, a spring actuated conducting elements or other thermal connections.

The unmanned aerial vehicle 10 may further include a rail body 580 positioned exterior to the lower cap 120 and or the upper cap 110. More specifically, the real body 580 may include a pic rail system. An attachment 582 may be removably coupled to the rail body 580. The attachment 582 may include but not limited to firearms, munitions, lights, lasers, communication devices, targeting systems, beacons, or other tools.

The unmanned aerial vehicle 10 may further include a container mount 600 for defining container channel 602. A container 604 is secured within the container channel 602 of the container mount 600 for coupling the container 604 to the fuselage 20. In the alternative, the container mount 600 may have a first container arm 610 and a second container arm 612 for defining container channel 614. The first container arm 610 is coupled to the fuselage 20. The second container arm 612 is coupled to the fuselage 20. The first container arm 610 and the second container arm 612 provide a compressive force against a container 604 for coupling the container 604 to the fuselage 20. The container 604 may include a parachute for safely descending the unmanned aerial vehicle 10 if a malfunction occurs. Alternatively, the container 604 may utilized for housing tools, food, water, medicine, documents, electronic devices or other supplies needed.

The container mount 600 may include mechanical fasteners for securing the container 604 to the fuselage 20. Alternatively the container mount 600 may include a first container arm 610 and a second container arm 612 that are movable by a container link 616 such that the container 604 may be dropped from the fuselage 20. More specifically, the container link 616 may release the compressive force against the container 604 and releasing the container 604 from the container mount 600.

Preferably, the unmanned aerial vehicle further includes a first leg 630 extending between a proximal end 632 and a distal end 634. The proximal end 632 of the first leg 630 is coupled to the fuselage 20. A second leg 640 extends between a proximal end 642 and a distal end 644. The proximal end 642 of the second leg 640 is coupled to the fuselage 20. A third leg 650 extends between a proximal end 652 and a distal end 654. The proximal end 652 of the third leg 650 is coupled to the fuselage 20. A fourth leg 660 extends between a proximal end 662 and a distal end 664. The proximal end 662 of the fourth leg 660 is coupled to the fuselage 20.

A first leg connector 636 removeably couples the proximal end 632 of the first leg 630 with the fuselage 20. A second leg connector 646 removeably couples the proximal end 642 of the second leg 640 with the fuselage 20. A third leg connector 656 removeably couples the proximal end 652 of the third leg 650 with the fuselage 20. A fourth leg connector 666 removeably couples the proximal end 662 of the fourth leg 660 with the fuselage 20. The first leg connector 636, the second leg connector 646, the third leg connector 656 and the fourth leg connector 666 may include a threaded bore and threaded rod, push pull connector, twist lock connector, snap pin connector, pin out connector or other fastening structures. The first leg connector 636, the second leg connector 646, the third leg connector 656 and the fourth leg connector 666 permit the expedited removal of the first leg 630, the second leg 640, the third leg 650 and the fourth leg 660 from the fuselage 20 such that the unmanned aerial vehicle 10 may be more easily transported, repaired if one leg becomes damaged and provides various options of interchanging the size and configuration of the legs.

The unmanned aerial vehicle 10 may include a first twist lock connector couples the first boom with the fuselage. A second twist lock connector couples the second boom with the fuselage. A third twist lock connector couples the third boom with the fuselage. A fourth twist lock connector couples the fourth boom with the fuselage.

A first electrical pin and a first electrical socket are interior to the first twist lock connector for electrically coupling the first rotor lift assembly with the electronic controller system. A second electrical pin and a second electrical socket are interior to the second twist lock connector for electrically coupling the second rotor lift assembly with the electronic controller system. A third electrical pin and a third electrical socket are interior to the third twist lock connector for electrically coupling the third rotor lift assembly with the electronic controller system. A fourth electrical pin and a fourth electrical socket are interior to the fourth twist lock connector for electrically coupling the fourth rotor lift assembly with the electronic controller system.

The unmanned aerial vehicle 10 may include a female twist lock connector and female electrical socket coupled to the fuselage. Furthermore, a male twist lock connector and a male electrical pin are coupled to the boom. Alternatively, this orientation of the twist lock connector and the electrical pin and electrical socket may be inverted. The boom may be alternatively coupled to the fuselage by a push poll connector or a magnetic connector.

An antenna may be coupled to the fuselage. An antenna twist lock connector couples the antenna with the fuselage. An antenna electrical pin and an antenna electrical socket are interior to the antenna twist lock connector for electrically coupling the antenna with the electronic controller system.

A sensor may be coupled to the fuselage. The sensor may include a 360 degree object avoidance sensor. The object avoidance sensor may include a closed array system or an open array system. More specifically the object avoidance sensor may include GPS navigation sensor, an infrared sensor, a microwave sensor, a lidar sensor, a ultrasonic sensor, a flow sensor or other navigation sensors. A sensor twist lock connector couples the sensor with the fuselage. A sensor electrical pin and a sensor electrical socket are interior to the sensor twist lock connector for electrically coupling the sensor with the electronic controller system.

A first angled member may be between the fuselage and the first boom for defining a first non-perpendicular orientation of the first boom relative to the fuselage. A second angled member may be between the fuselage and the second boom for defining a second non-perpendicular orientation of the second boom relative to the fuselage. The first non-perpendicular orientation and the second non-perpendicular orientation distance the first rotor lift assembly and the second rotor lift assembly on a first side of the fuselage for permitting increased sized first rotor lift assembly and second rotor lift assembly. The specifically, the first non-perpendicular orientation and the second non-perpendicular orientation permit larger diameter propeller blades to be installed on the first rotor lift assembly and the second rotor lift assembly.

A third angled member may be between the fuselage and the third boom for defining a third non-perpendicular orientation of the third boom relative to the fuselage. A fourth angled member may be between the fuselage and the fourth boom for defining a fourth non-perpendicular orientation of the fourth boom relative to the fuselage. The third non-perpendicular orientation and the fourth non-perpendicular orientation distance the first rotor lift assembly and the second rotor lift assembly on a second side of the fuselage for permitting increased sized third rotor lift assembly and fourth rotor lift assembly.

Quick Disconnect Booms

1. A female to male twist lock reverse bayonet style connector is integrated into the booms of the drone for quick and easy assembly and option for interchangeable boom sizes. (The type of connector may change to different locking styles such as a push-pull connector)

Object Avoidance Quick Disconnect Housing and Saddle

1. A saddle is integrated onto the top cover of the drone with one mate of a twist lock reverse bayonet style connector. The mating connector is mounted to a housing designed to secure the 360 degrees object avoidance sensor. (The type of connector may change to different locking styles such as a push-pull connector)

Push Button Release Mechanism

1. A spring-loaded catch actuated by a button is mounted to both ends of the center chassis of the drone. The catch inter-locks with the mating pin to easily attach and remove the top and bottom covers of the drone.

The unmanned aerial vehicle unique features:

The unmanned aerial vehicle can be used for intelligence, surveillance and reconnaissance (ISR), Search & Rescue, Less-Than-Lethal and is munitions capable.

For use in a wide array of applications to include; inside a GPS denied space, search and rescue, security, oil and gas, CQB, 2-7 km ISR, possible light munitions delivery system for items such as grenades and/or other small warheads, less than lethal weapons such as the FN-303 or Pepper Ball, and or other even lethal weapons for use in law enforcement or Military applications.

In addition to the aforementioned applications this unmanned aerial vehicle can be made amphibious with the ability to float and in the future possibly even swim on-top surface.

There is a unique FLIR Duo camera model, sensor bracket that is adjustable but it's not limited in any way to this model or brand of sensors.

The unmanned aerial vehicle is very aerodynamic in comparison to other aerial vehicles.

This new variation features a more aerodynamic three/sub-assemblies that are sealed (gasketed) against one another. This construction method is comprised of an upper composite cover sub-assembly, a middle structural aluminum chassis/parting bracket sub-assembly and a composite lower enclosure. The unmanned aerial vehicle's upper housing, sub-assembly also features a radiolucent airfoil aerial antenna mount for the GPS and houses other antennas such as ones for video.

The unmanned aerial vehicle 10 may include a middle aluminum chassis that features hard mounting points for any/all critical hardware. This extruded and CNC post-processed aluminum chassis provides mounting surfaces for all electronics, booms, cameras and batteries. It even features a wiring management area, new bullet/pogo-pin connections between the chassis and the lower battery housing and much more.

Initially this product may be fabricated from the following; CNC machined aluminum but in the future, and may be comprised largely of extruded materials or discontinuous composite materials and is in no way limited to this kind of construction. Other unique material solutions include; both continuous thermoplastic and other flowable snap cure thermoset composite materials and processes, EMI shielding will be Insitu-laminated strategically into its fuselage.

Conversely, the upper fuselage/antenna-aerial, cap is molded from radiolucent materials.

A female to male twist lock reverse bayonet style connector is integrated into the booms of the drone for quick and easy assembly and option for interchangeable boom sizes. (The type of connector may change to different locking styles such as a push-pull connector)

Object avoidance quick disconnect housing and saddle; a saddle is integrated onto the top cover of the drone with one mate of a twist-lock reverse bayonet style connector. The mating connector is mounted to a housing designed to secure the 360 degrees object avoidance sensor. (The type of connector may change to different locking styles such as a push-pull connector) This sensor may be a true Lidar system in the future or even just some form of other antenna module.

Push button release mechanism; a spring-loaded catch actuated by a button is mounted to both ends of the center chassis of the drone. The catch inter-locks with the mating pin to easily attach and remove the top and bottom covers of the drone.

Spring loaded cover latch (tongue and groove); a locking mechanism where a grooved feature is mounted to the center chassis of the drone and is mated to an adjustable spring-loaded tongue feature. The tongue feature is attached to the covers of the drone. This process aligns and starts the mating process of the top and bottom covers to the center chassis.

The addition of these highly modified cylindrical connector sub-assemblies makes repairs extremely simple. Most drones require extensive wiring and soldering in-order to change a boom assembly or even just one motor. The unmanned aerial vehicle 10 may be extremely functional/intuitive and beneficial to the user for future upgrades or repairs.

The custom aluminum shell backing to the connector is a critical feature for this patent as its designed and turned on a lathe to exacting specification to behave like the normal shell, cable clamp or strain-relief ordinarily threaded onto the back of a mating connector. In the case of how its being used here the shell design is modified to receive a boom tube of some sort instead. This could even be a fixed wing aircraft tail boom assembly.

The unmanned aerial vehicle is extremely modular due to its simple mostly rectangular shape. The unmanned aerial vehicle includes a sleeker shape on-top but increases its practical space, whereby, making it even easier to add almost any type of payload including; lidar, FLIR, gimbals, weapons and much more.

The rotors can be shrouded with an airfoil design or three asymmetrical airfoils generating lift in forward attitude mode/flight. The sides can be up of symmetrical airfoils providing fin style guidance in forward fight. This unique airfoil shroud would be manufactured from composite materials or thermoplastics whereby reducing the risk of someone being injured by a collision and generating lift improving overall energy consumption. Alternatively, a simple rotor shroud to prevent bump injuries or damage to or from hitting objects may be added for some customers.

The airfoil/rotor guard and wing structure which utilizes lift surfaces to optimize flight time and flight control is a possible configuration that may be added. Some configurations may be more VTOL oriented, not requiring an airfoil whereby a simple rotor guard may be employed.

The unmanned aerial vehicle 10 may include a fuselage that is assembled using nothing but easy to operate push-button plunger and striker assemblies.

There is now a unique custom-made gimbal that operates on one axis for the FLIR Duo Pro R camera model sensor and it's not limited in any way to this model or brand of sensors. One of the new ideal sensors being incorporated on this model is the NextVision Colibri 2 3 axis gimbal camera.

The unmanned aerial vehicle 10 may include easy, CNC/Lathe cut booms which were adapted to the new cylindrical connectors and they still feature extruded/CNC cut motor mounts. The design lends itself to being lengthened or shortened to accommodate smaller or larger motors depending on payload requirements.

The booms may feature a breakaway groove, whereby, allowing them to fail during crashes or extremely rough landings to absorb impacts. This feature will minimize the energy transferred into more expensive or harder to replace components. The booms may be tapered to minimize surface area. Additionally, the booms can still be optionally folded when using two blade rotors with a corresponding hinged clevis or alike component. The fuselage design is completely scalable either up or down in size.

The main fuselage is still a rigid aluminum or composite tub with two sealed (gasketed) composite covers, although, they have all changed somewhat in proportions/shape and these parts are in no way limited to these material categories. Machined parting area flange provides an easy sealing surface by creating an undercut surface above the tub. All electrical components sit in-line (longitudinally) to include; speed controls, autopilot, batteries and more, making this design intuitive to service and integrate with almost any electronic payload.

The booms can provide motor support for X4-quad motor/rotor configurations or even as shown, X8 counter rotating high thrust versions. This configuration is in an angled H-pattern due largely to the CNC/lathe machined booms and its practicality.

There are riser blocks between the boom connectors (mounted within) and the main chassis sub-assembly to allow for angling the booms, whereby, creating more space between the rotor tips. This allows the unmanned aerial vehicle to keep its trim fuselage size and yet accommodate oversized rotors and motors when required.

The unmanned aerial vehicle may be constructed from any of the below composite construction design methodology:

Engineered Molding Compound (EMC). This is a Snap-Cure (fast cure, usually less than 7 minutes), discontinuous quasi-isotropic 3-D oriented fiber. This designation tends to be for more high-end, lightweight materials such as T-700 PAN Carbon Fiber.

Sheet Molding Compound (SMC). This is usually a Snap-Cure, discontinuous quasi-isotropic 3-D oriented fiber.

Thick Molding Compound (TMC). This is a Snap-Cure material that maybe used to create thicker than normal cross-sections like a parting edge. It can be combined with other alike materials such as EMC, SMC and BMC.

Bulk Molding Compound (BMC). This is sometimes discontinuous chopped fiber or fiber tape and can be either a Snap Cure Epoxy, Vinyl-Ester or even a Thermoplastic System.

Thermoplastic continuous fiber solutions. This comes as a dry pre-impregnated, comingled fiber, powder-coated with polymer or pre-consolidated fiber solution.

Thermoplastic discontinuous fiber solutions. This comes as a dry pre-impregnated, comingled fiber, powder-coated with polymer or pre-consolidated fiber solution.

Thermoset continuous fiber solutions. This comes as a dry fiber/add resin or a pre-impregnated fiber solution.

Thermoset discontinuous fiber solutions. This is the fundamental necessity for it to be a semi flow-able solution.

Compression Molding. All of these materials can be molded in closed matched-metal tools in presses this way.

Long Fiber Thermoplastic Solutions (LFT). This can be compression molded, injection molded or even extruded.

Hybrid Injection and Combined Compression Molding. This process allows for thermoplastic continuous fiber materials to be compression molded and then for homogenous thermoplastic to be injected onto one side or another, whereby, creating extremely complex geometry such as ribs or bosses.

These materials coupled with the associated processes are capable of forcing resin and fiber into complex composite parts with tremendous variation in wall thicknesses.

The unmanned aerial vehicle 10 may include easily removable twist-lock style booms. These booms use either integral reverse-bayonet style connectors (as shown), bayonet, push-pull, spring-collar, or cam style connectors. Brands include; Amphenol, ODU, Fischer, Lemo, GlenAir Ulti-mate but are in no way limited to the aforementioned. The booms can be lengthened or shortened easily on a lathe to accommodate different lengths of rotors. The booms may have a groove at their base, designed to shear off should they encounter a hard landing to minimize and hopefully eliminate damage to the main airframe.

Motor mounts depict a counter rotating X8 configuration (as shown) but can instead be configured as a quad, a hex X6 or even an octo-copter. The first lock connector 150, second lock connector 152, the third lock connector 154 and the fourth lock connector 156, may include military style connectors that are structurally integrated into booms. The first lock connector 150, second lock connector 152, the third lock connector 154 and the fourth lock connector 156, may further include military style cylindrical connectors to a sUAS (drones) providing a IP-68 waterproof rating, are extremely easy to twist-lock or push-pull in-place, extremely structural, precision, well defined features, easy to operate while using tactical gloves and they make assembling an removing the booms easy, or in just a few seconds.

The first lock connector 150, second lock connector 152, the third lock connector 154 and the fourth lock connector 156, prevents the military from struggling to repair VTOL sUAS insome cases suffered only minor impacts during flight and yet became inoperable as a result of a crash and requiring being shipped back from a Theater of War to the U.S. for repairs or replacement. These replaceable booms change all of this for the better allowing a soldier or a repair technician simply twist off a damaged boom and twist on a new boom in its place.

The object avoidance (LIDAR) tower is utilizing the same style of connectors as the booms. This connector is wired into the LIDAR base and allows for easy removal and replacement of the device. It also allows for quick assembly or disassembly of the aircraft for storage in a matter of seconds.

The upper fuselage fairing and the battery enclosure utilize the same tongue and groove and latch features, both equal and opposite one-another. These create a positive lock, are extremely structural and provide a safe and secure attachment for heavy components in seconds. They also provide a constant load to the gaskets within the top fairing and the lower battery enclosures. The upper fairing/fuselage is currently manufactured from quasi-isotropic 3-D oriented carbon fiber.

The main chassis is currently CNC machined from 6061-T6 aluminum. The battery enclosure can be injection molded from thermoplastic or compression molded from advanced composite materials. The cantilevered gimbal is unique in that it utilizes a servo system or elevation and may in the future be upgraded for an additional axis of movement to cover rotation. Currently the gimbal is CNC machined from 6061-T6 aluminum.

The unmanned aerial vehicle 10 is capable of supporting a multi-mission role with the ability to easily swap payloads under the battery up to 15 pounds. The unmanned aerial vehicle 10 is a completely scalable design either larger or smaller depending on the mission and payload requirements. The unmanned aerial vehicle 10 utilizes a four main component construction. Comprised of an object avoidance tower utilizing a twist lock connector, a dielectric aerial with GPS puck, an upper carbon fiber fuselage, a main structural aluminum chassis and finally the lower battery enclosure. The fuselage is designed to be a water resistant structure. The entire airframe is envisioned to be manufactured using advanced composites and make best use of high-speed, quasi-isotropic 3-D oriented fiber. The skids thread in-place and are comprised of a structural titanium screw mated to the main chassis and utilizes a flexible composite shaft that may shear off during a hard landing to absorb shock reduce the risk for damage to the aircraft. The battery connections are made using either pogo spring pins, or ODU pinned high amperage connectors with custom bracketry. Some connections between the flow sensor on the bottom of the battery and the main chassis autopilot are accomplished using pogo-pins.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A spring-operated catch mechanism including:

a catch actuator (366);

a spring (368) coupled to said catch actuator (366);

a spring-operated catch (360) for supporting the catch actuator (366) and the spring (368);

a pin receiver (370) coupled to the spring-operated catch (360);

a cap catch (380);

said cap catch (380) for engaging with said spring-operated catch (360) for defining a frame fastener (390); and said catch actuator (366) coupled to said spring-operated catch (360) for depressing said catch actuator (366) within said spring-operated catch (360) and separating said spring-operated catch (360) from said cap catch (380);

the spring-operated catch (360) includes a catch base (362) and a catch channel (364) within the catch base (362);

the cap catch (380) includes a mounting base (382), a pin (384) coupled to said mounting base (382), a pin groove (386) on said pin (384), and a pin tapered surface (388), wherein said pin (384) extends through said pin receiver (370) to engage or disengage with said pin receiver (370), wherein said pin receiver (370) is positioned within said catch channel (364) and within said pin groove (386) during engagement with said pin (384) and said pin receiver (370) is positioned within said catch channel (364) and outside of said pin groove (386) during disengagement with said pin (384).

2. The spring-operated catch mechanism of claim 1 further including:

said pin receiver (370) further including a pin receiver aperture (370*a*), a first pin receiver surface (370*b*), and a second pin surface (370*c*) and wherein said pin (384) remains extended through said pin receiver aperture (370*a*) as said pin (384) engages and disengages with said pin receiver (370).

3. The spring-operated catch mechanism of claim 1 wherein pressed said catch actuator (366) translates said pin receiver (370) to move said pin receiver from said pin groove (386) for disengagement and when said catch actuator (366) is unpressed said pin receiver (370) is positioned within said pin groove (386) for engagement.

* * * * *